US011126124B2

(12) United States Patent
Yamazaki et al.

(10) Patent No.: US 11,126,124 B2
(45) Date of Patent: Sep. 21, 2021

(54) IMAGE READING DEVICE AND IMAGE FORMING APPARATUS INCORPORATING SAME

(71) Applicants: Kimiharu Yamazaki, Kanagawa (JP); Hideyo Makino, Tokyo (JP); Susumu Mikajiri, Tokyo (JP); Satoshi Nakayama, Kanagawa (JP); Hiroki Yamamura, Tokyo (JP); Kohta Aoyagi, Kanagawa (JP); Tohru Matsumoto, Kanagawa (JP)

(72) Inventors: Kimiharu Yamazaki, Kanagawa (JP); Hideyo Makino, Tokyo (JP); Susumu Mikajiri, Tokyo (JP); Satoshi Nakayama, Kanagawa (JP); Hiroki Yamamura, Tokyo (JP); Kohta Aoyagi, Kanagawa (JP); Tohru Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/102,405

(22) Filed: Nov. 23, 2020

(65) Prior Publication Data

US 2021/0165355 A1 Jun. 3, 2021

(30) Foreign Application Priority Data

Nov. 29, 2019 (JP) ..... JP2019-217066
Nov. 6, 2020 (JP) ..... JP2020-185922

(51) Int. Cl.
*G03G 15/00* (2006.01)

(52) U.S. Cl.
CPC ..... *G03G 15/5062* (2013.01); *G03G 15/6552* (2013.01); *G03G 15/757* (2013.01)

(58) Field of Classification Search
CPC ..... G03G 15/5041; G03G 15/5062; G03G 15/6552; G03G 15/757; H04N 1/0057; H04N 1/00816
See application file for complete search history.

(56) References Cited

U.S. PATENT DOCUMENTS 5,983,066 A 11/1999 Abe et al.
9,185,253 B2 * 11/2015 Yoneyama ..... H04N 1/00602
(Continued)

FOREIGN PATENT DOCUMENTS

EP 2028557 A2 2/2009
EP 3537221 A1 9/2019
(Continued)

OTHER PUBLICATIONS

European Search Report: Application EP20210167; dated Feb. 25, 2021.

*Primary Examiner* — Hoang X Ngo
(74) *Attorney, Agent, or Firm* — Duft & Bornsen, PC

(57) ABSTRACT

An image reading device includes a plurality of image reading units arranged at different positions in a width direction perpendicular to a conveyance direction of a recording medium to read an image on the recording medium at image reading positions and a conveyance roller pair that conveys the recording medium to the plurality of image reading units. The conveyance roller pair includes a drive roller and a driven roller that contacts the drive roller and rotates following the drive roller. The plurality of image reading units includes an upstream and a downstream image reading units downstream from the upstream image reading unit in the conveyance direction. A reading interval between the image reading positions and a diameter of the drive roller satisfy the relation:

$X2=n1\times\pi\times D1a,$ (Continued)

where X2 represents the reading interval, n1 represents an integer, and D1a represents the diameter of the drive roller.

20 Claims, 10 Drawing Sheets

(56) References Cited

U.S. PATENT DOCUMENTS

| | | | |
|---|---|---|---|
| 2013/0049287 | A1 | 2/2013 | Ueda et al. |
| 2013/0286442 | A1 | 10/2013 | Nishida |
| 2014/0314281 | A1 | 10/2014 | Kojima et al. |
| 2014/0347712 | A1 | 11/2014 | Yoneyama et al. |
| 2015/0378297 | A1 | 12/2015 | Nakura et al. |
| 2016/0182753 | A1 | 6/2016 | Takahashi et al. |
| 2017/0131671 | A1 | 5/2017 | Nishimura et al. |
| 2017/0153591 | A1 | 6/2017 | Nakura et al. |
| 2019/0202648 | A1 | 7/2019 | Nakayama et al. |
| 2020/0301326 | A1 | 9/2020 | Yamazaki et al. |

FOREIGN PATENT DOCUMENTS

| | | | |
|---|---|---|---|
| JP | H03240358 | A | 10/1991 |
| JP | H1127477 | A | 1/1999 |
| JP | 2005136593 | A | 5/2005 |
| JP | 2007-004137 | | 1/2007 |
| JP | 2008-271473 | | 11/2008 |
| JP | 2012-027133 | | 2/2012 |
| JP | 2012-165296 | | 8/2012 |
| JP | 2014-074711 | | 4/2014 |
| JP | 2015-029192 | | 2/2015 |
| JP | 2016-118777 | | 6/2016 |
| JP | 2016-139026 | | 8/2016 |
| JP | 2017028604 | A | 2/2017 |
| JP | 2017-076845 | | 4/2017 |
| JP | 2017-076846 | | 4/2017 |
| JP | 2017-228165 | | 12/2017 |
| JP | 2019-121893 | | 7/2019 |

* cited by examiner

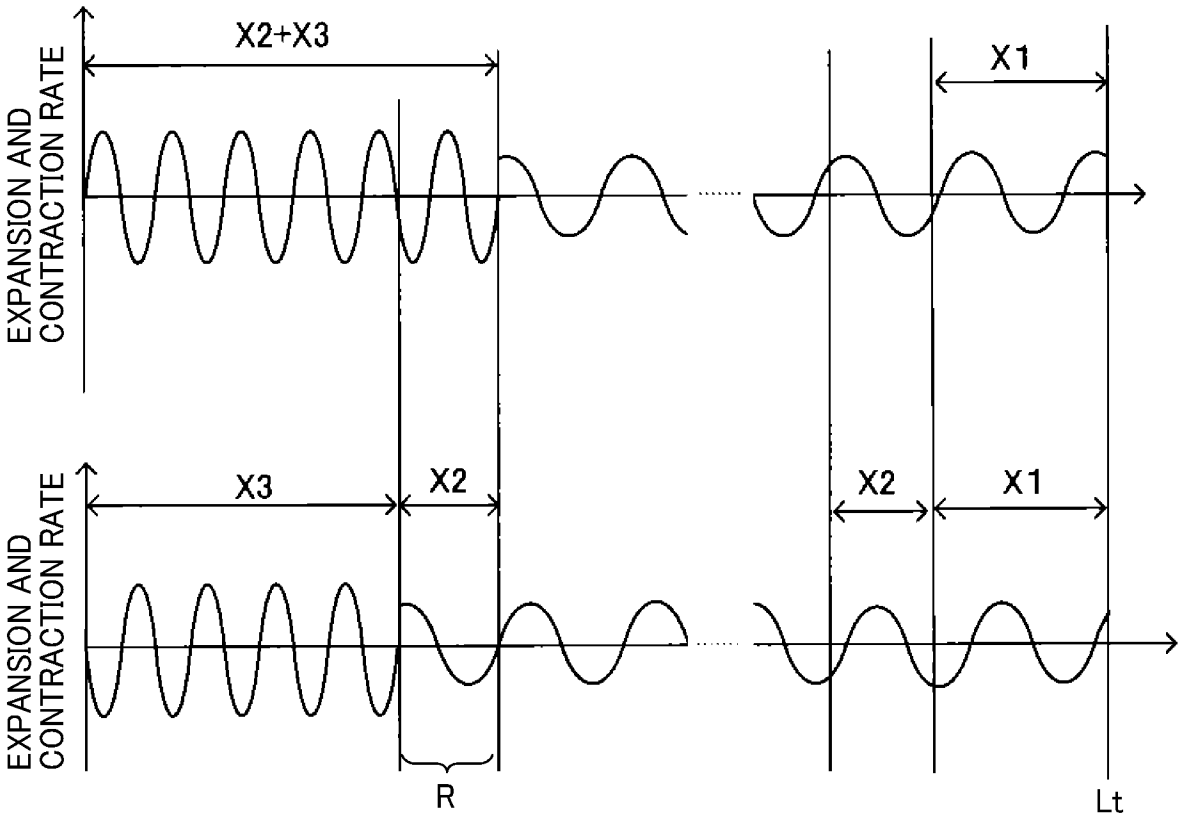
FIG. 7A COMPARATIVE EXAMPLE
FIG. 7B COMPARATIVE EXAMPLE

IMAGE READING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-217066, filed on Nov. 29, 2019 and 2020-185922, filed on Nov. 6, 2020, in the Japan Patent Office, the entire disclosure of each of which is hereby incorporated by reference herein.

BACKGROUND

Technical Field

Embodiments of the present disclosure relate to an image reading device, and an image forming apparatus incorporating the image reading device.

Description of the Related Art

There is known an image reading device including a first conveyance roller pair. The first conveyance roller pair includes a first drive roller and a first driven roller. The first driven roller contacts the first drive roller and rotates following the first drive roller. The first conveyance roller pair conveys a recording medium to a plurality of image reading units. The plurality of image reading units is arranged at a predetermined interval in a conveyance direction of the recording medium and at different positions in the width direction perpendicular to the conveyance direction.

SUMMARY

Embodiments of the present disclosure describe an improved image reading device that includes a plurality of image reading units and a conveyance roller pair that conveys a recording medium to the plurality of image reading units. The plurality of image reading units is arranged at different positions in a width direction perpendicular to a conveyance direction of the recording medium to read an image on the recording medium at image reading positions. The plurality of image reading units includes an upstream image reading unit and a downstream image reading unit downstream from the upstream image reading unit in the conveyance direction. The conveyance roller pair includes a drive roller and a driven roller that contacts the drive roller and rotates following the drive roller. A reading interval between the respective image reading positions and a diameter of the drive roller satisfy the following relation:

$$X2=n1\times\pi\times D1a,$$

where X2 represents the reading interval, n1 represents an integer, and D1a represents the diameter of the drive roller.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 7A and 7B are graphs illustrating expansion and contraction of a first scanned image and a second scanned image according to a comparative example;

Figure 1:
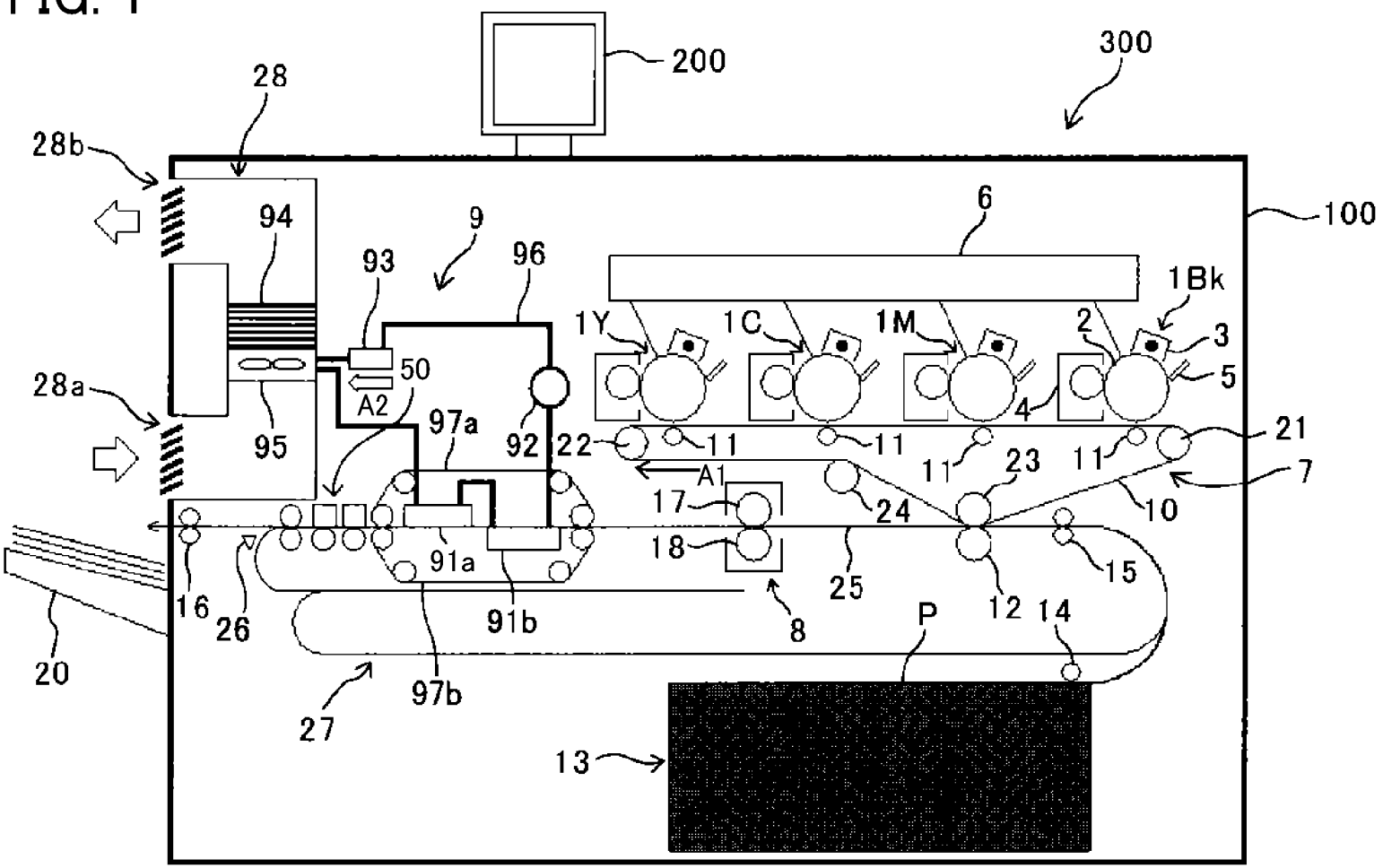
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

A comparative image reading device conveys a recording medium toward a plurality of image reading units arranged in a staggered pattern. However, when scanned images read by the plurality of image reading units are combined together into a single image, an abnormal image such as a vertical streak may be generated at a portion corresponding to the joint of the scanned images.

According to the present disclosure, an abnormal image can be prevented from being generated in a composite scanned image in which scanned images read by a plurality of image reading units are combined.

A description is given below of a printer that is a full-color electrophotographic image forming apparatus according to an embodiment of the present disclosure. The configuration of an image forming apparatus (printer) 300 according to the present embodiment are schematically described. FIG. 1 is a schematic view illustrating the configuration of the image forming apparatus 300 according to the present embodiment. The image forming apparatus 300 according to the present embodiment can function as a copier by adding an optional scanner to the upper portion of an apparatus body 100 thereof, and further as a multifunction peripheral having a facsimile function by adding an optional facsimile board inside the apparatus body 100.

As illustrated in FIG. 1, the image forming apparatus 300 according to the present embodiment includes a control panel 200 disposed on the apparatus body 100. The control panel 200 displays the operation state of the image forming apparatus 300, and a user can set the operation condition of the image forming apparatus 300 with the control panel 200. In the image forming apparatus 300, an image is formed by the electrophotographic method on a sheet P which is a sheet-shaped recording medium based on image data received from an external device such as a personal computer and the operation condition set by the control panel 200.

A description is given below of the configuration and operation of the apparatus body 100 that performs image formation in the image forming apparatus 300. As illustrated in FIG. 1, the apparatus body 100 of the image forming apparatus 300 includes four process units 1Y, 1C, 1M, and 1Bk as image forming units and a transfer unit 7 including an intermediate transfer belt 10 as an intermediate transferor. The process units 1Y, 1C, 1M, and 1Bk are arranged in parallel on the stretched surface of the intermediate transfer belt 10 and constructs a tandem type image forming device together with the transfer unit 7. The process units 1Y, 1C, 1M, and 1Bk are removably installable in the apparatus body 100 and have the same configuration except for containing different color toners, i.e., yellow (Y), magenta (M), cyan (C), or black (Bk) toners, respectively, corresponding to decomposed color components of full-color images.

Specifically, the process unit 1 includes a drum-shaped photoconductor 2 as an electrostatic latent image bearer, a charging device 3 to charge the surface of the photoconductor 2, a developing device 4 to form a toner image on the surface of the photoconductor 2. The process unit 1 further includes a cleaning blade 5 as a cleaning device to clean the surface of the photoconductor 2. In FIG. 1, reference numerals of the photoconductor 2, the charging device 3, the developing device 4, and the cleaning blade 5 are indicated in the process unit 1Bk but are omitted in the process units 1Y, 1C, and 1M for simplicity.

As illustrated in FIG. 1, an exposure device 6 to expose the surface of the photoconductor 2 is disposed above the process units 1Y, 1C, 1M, and 1Bk. The exposure device 6 includes a light source, a polygon mirror, an f-O lens, and reflection mirrors to irradiate the surfaces of the photoconductors 2 with laser beams according to the image data.

The transfer unit 7 is disposed below the process units 1Y, 1C, 1M, and 1Bk. As described above, the transfer unit 7 includes the intermediate transfer belt 10 that is an endless belt as the intermediate transferor. The inner circumferential surface of the intermediate transfer belt 10 is stretched around a first stretch roller 21, a second stretch roller 22, and a third stretch roller 23 as supports, and a tension roller 24 presses the intermediate transfer belt from the outer circumferential surface toward the inner circumferential surface, thereby applying tension to the intermediate transfer belt 10. As a drive roller rotates, which is one of the first stretch roller 21, the second stretch roller 22, and the third stretch roller 23, the intermediate transfer belt 10 rotates in the clockwise direction indicated by arrow A1 in FIG. 1.

Four primary transfer rollers 11 are disposed opposite the respective four photoconductors 2 via the intermediate transfer belt 10. At the position opposite the corresponding photoconductor 2, each of the primary transfer rollers 11 presses the inner circumferential surface of the intermediate transfer belt 10 against the corresponding photoconductor 2 to form a primary transfer nip where a pressed portion of the intermediate transfer belt 10 contacts the photoconductor 2. The primary transfer rollers 11 are electrically connected to a power source, and a predetermined voltage that is either direct current (DC) voltage, alternating current (AC) voltage, or including both is applied to the primary transfer rollers 11.

A secondary transfer roller 12 is disposed opposite the third stretch roller 23 that stretches the intermediate transfer belt 10. The secondary transfer roller 12 is pressed against the outer circumferential surface of the intermediate transfer belt 10 to form a secondary transfer nip where the secondary transfer roller 12 contacts the intermediate transfer belt 10. Similarly to the primary transfer rollers 11, the secondary transfer roller 12 is electrically connected to a power source, and a predetermined voltage that is either DC voltage, AC voltage, or including both is applied to the secondary transfer roller 12.

A plurality of sheet trays 13 is disposed at the lower portion of the apparatus body 100 to accommodate sheets P as sheet-shaped recording media, such as paper sheets, overhead projector (OHP) transparencies, and the like. A sheet feeding roller 14 is provided in the sheet tray 13 to feeds the sheets P accommodated in the sheet tray 13. An output tray is disposed on the left outer surface of the side plate of the apparatus body 100 in FIG. 1. The sheets P ejected from the apparatus body 100 are stacked on the output tray 20.

A conveyance path 25 is formed inside the apparatus body 100, and the sheet P is conveyed from the sheet tray 13 to the output tray 20 via the secondary transfer nip along the conveyance path 25. Along the conveyance path 25, a registration roller pair 15 is disposed upstream from the secondary transfer roller 12 in a direction of conveyance of the sheet P (hereinafter referred to as a conveyance direction). A fixing device 8, a cooling device 9, an image reading device 50, and an output roller pair 16 are disposed downstream from the secondary transfer roller 12 in the conveyance direction in order. The fixing device 8 includes, for example, a fixing roller 17 including a heater therein and a pressure roller 18 that presses the fixing roller 17. The portion where the fixing roller 17 and the pressure roller 18 contact each other is referred to as a fixing nip.

A switching pawl 26 is disposed between the image reading device 50 and the output roller pair 16. A reverse path 27 is formed between the sheet trays 13, and fixing device 8 and the cooling device 9. When the duplex printing, in which images are formed on both sides of the sheet P, is selected among printing modes as image formation modes, the switching pawl 26 swings to guide the sheet P from the conveyance path 25 to the reverse path 27. The sheet P guided to the reverse path 27 switchbacks in the reverse path 27 to reverse the front and back surfaces of the sheet P. Then the sheet P enters the conveyance path 25 upstream from the registration roller pair 15 to form an image on the back surface of the sheet P.

The cooling device 9 includes a front side belt 97*a* and a back side belt 97*b*. The front side belt 97*a* is an endless cooling belt that removes heat from the front surface of the sheet P, while conveying the sheet P. The back side belt 97*b* is an endless cooling belt that removes heat from the back surface of the sheet P, while conveying the sheet P. The sheet P is conveyed, while being sandwiched between the stretched surfaces of the front side belt 97*a* and the back side belt 97*b*. The cooling device 9 further includes a front side cooling plate 91*a* and a back side cooling plate 91*b*. The front side cooling plate 91*a* is disposed inside the stretched surface of the front side belt 97*a*. The back side cooling plate 91*b* is disposed inside the stretched surface of the back side belt 97*b*. Further, the cooling device 9 includes a pump 92, a tank 93, a radiator 94, and a cooling fan 95. The front side cooling plate 91*a* and the back side cooling plate 91*b* are heat receivers that receive the heat from the sheet P. The tank 93 stores a coolant. Pipes 96 are coupled to the inlet and outlet provided in each of the front side cooling plate 91*a* and the back side cooling plate 91*b*, and the coolant is circulated between the front side cooling plate 91*a*, the back side cooling plate 91*b*, the radiator 94, the tank 93, and the pump 92 via the pipes 96, thereby forming a circulation path. The pump 92 transports the coolant stored in the tank 93 through the pipes 96. The front side cooling plate 91*a* and the back side cooling plate 91*b* transfer the heat from the sheet P to the coolant. The radiator 94 dissipates the heat removed by the coolant to the outside of the image forming apparatus 300. The cooling fan 95 is attached to the radiator 94 and generates an airflow around the radiator 94 to cool the radiator 94.

As indicated by arrow A2, in the circulation path, the coolant is cooled by the radiator 94 and supplied to the front side cooling plate 91*a* and the back side cooling plate 91*b* through the circulation path. Then, the coolant is discharged from the back side cooling plate 91*b* through the front side cooling plate 91*a*. After that, the coolant is transported to the pump 92 and the tank 93, and then returned to the radiator 94 again. The coolant is circulated by the pump 92, and the radiator 94 dissipates heat to cool the coolant, thereby cooling the front side cooling plate 91*a* and the back side cooling plate 91*b*. The liquid transport capacity of the pump 92 and the size of the radiator 94 are based on the flow rate, pressure, cooling efficiency, and the like determined by thermal design conditions (e.g., conditions of the amount of heat removed by the front side cooling plate 91*a* and the back side cooling plate 91*b* and the temperature of the front side cooling plate 91*a* and the back side cooling plate 91*b*).

The cooling fan 95 and the radiator 94 are disposed in a duct 28. The duct 28 is arranged inside the side plate of the apparatus body 100 on which the output tray 20 is disposed. When the cooling fan 95 is driven (rotated), low temperature air is suck into the duct 28 through an intake port 28*a*. Then the air passes through the cooling fan 95 and the radiator 94, thereby becoming high temperature. The high temperature air is exhausted from an exhaust port 28*b*. The intake port 28*a* is disposed in the lower portion of the duct 28, and the exhaust port 28*b* is disposed in the upper portion of the duct 28 in FIG. 1.

Next, a description is given of the basic operation of the image forming apparatus 300 when the single-sided printing is selected among the printing modes. As the image forming apparatus 300 receives image data from an external device such as a personal computer and starts the image forming operation, the photoconductor 2 of each of the process units 1Y, 1C, 1M, and 1Bk rotates counterclockwise in FIG. 1, and the charging device 3 uniformly charges the surface of the photoconductor 2 in a predetermined polarity. Then, the exposure device 6 irradiates the charged surfaces of the respective photoconductors 2 with laser beams based on the image data received from the external device and processed by an image processor. Thus, electrostatic latent images are formed on the surfaces of the respective photoconductors 2. At this time, the image data for exposing the photoconductor 2 is single-color image data obtained by decomposing a desired full-color image into individual color components, that is, yellow, cyan, magenta, and black components. The electrostatic latent image thus formed on the photoconductor 2 is developed into a toner image (visible image) with toner deposited by the developing device 4.

The intermediate transfer belt 10 rotates in the direction indicated by arrow A1 in FIG. 1 as the drive roller rotates, which is one of the stretch rollers 21 to 23 around which the intermediate transfer belt 10 is stretched. The power source applies a constant voltage or a voltage controlled at a constant current, which has a polarity opposite a polarity of the charged toner, to the primary transfer rollers 11. As a result, primary transfer electric fields are generated at the respective primary transfer nips between the primary transfer rollers 11 and the photoconductors 2. The primary transfer electric fields generated at the primary transfer nips sequentially transfer and superimpose the toner images of respective colors from the photoconductors 2 onto the intermediate transfer belt 10. Thus, a full-color toner image, which is the superimposed toner images, is formed on the surface of the intermediate transfer belt 10. Residual toner remaining on the photoconductor 2 failed to be transferred onto the intermediate transfer belt 10 is removed by the cleaning blade 5 in preparation for subsequent image formation.

Meanwhile, as the sheet feeding roller 14 rotates, the sheet P is fed out from the sheet tray 13. The registration roller pair 15 forwards the sheet P fed from the sheet tray 13 to the secondary transfer nip between the secondary transfer roller 12 and the intermediate transfer belt 10 at appropriate timing to synchronize with the arrival of the toner images carried on the intermediate transfer belt 10. At that time, a secondary transfer voltage opposite in polarity to the toner images on the intermediate transfer belt 10 is applied to the secondary transfer roller 12, and a secondary transfer electric field is generated in the secondary transfer nip. The secondary transfer electric field generated in the secondary transfer nip collectively transfers the toner images (full-color toner image) from the intermediate transfer belt 10 onto the sheet P.

The sheet P bearing the full-color toner image is then conveyed to the fixing device 8. The fixing roller 17 and the pressure roller 18 apply heat and pressure to the sheet P to fix the full-color toner image on the sheet P. The cooling device 9 cools the sheet P, and the output roller pair 16 ejects the sheet P onto the output tray 20. By cooling the sheet P by the cooling device 9, the toner on the sheet P can be reliably cured at the time when the sheet P is stacked on the output tray 20.

Described above is the image forming operation to form a full-color toner image on the sheet P. Alternatively, the image forming apparatus 300 may form a monochrome toner image by using any one of the four process units 1Y, 1C, 1M, and 1Bk, or may form a bicolor toner image or a tricolor toner image by using two or three of the process units 1Y, 1C, 1M, and 1Bk.

Figure 2:
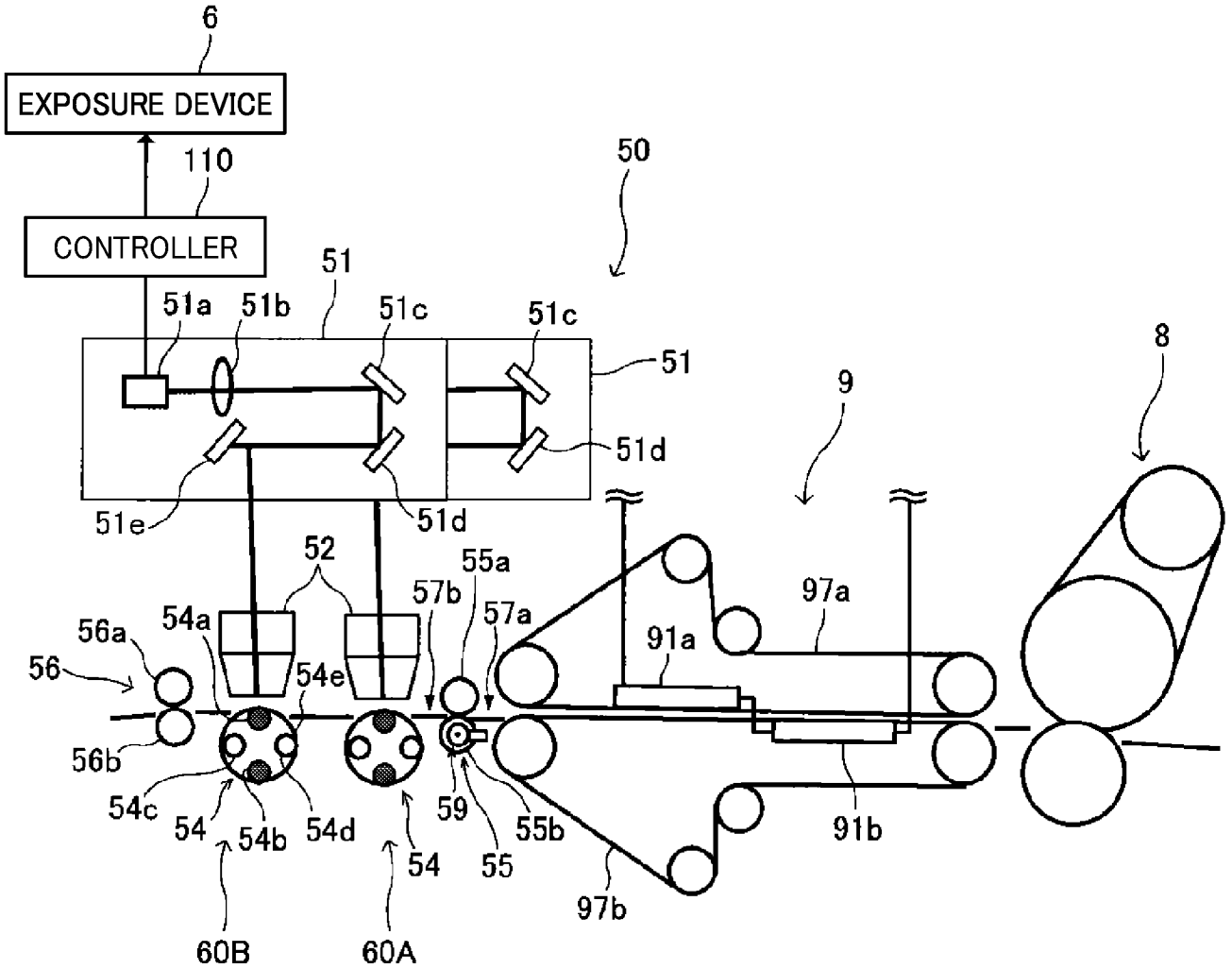
FIG. 2 is a schematic view illustrating a configuration of a conveyance device including a fixing device, a cooling device, and an image reading device according to an embodiment of the present disclosure.

FIG. 2 is a schematic view illustrating the configuration of a conveyance device including the fixing device 8, the cooling device 9, and the image reading device 50. The sheet P after the cooling process by the cooling device 9 is then conveyed to the image reading device 50. The image reading device 50 includes a first image reading unit 60A, a second image reading unit 60B, a first conveyance roller pair 55 including a first drive conveyance roller 55*a* and a first driven conveyance roller 55*b*, and a second conveyance roller pair 56 including a second drive conveyance roller 56*a* and a second driven conveyance roller 56*b*.

Figure 6A:
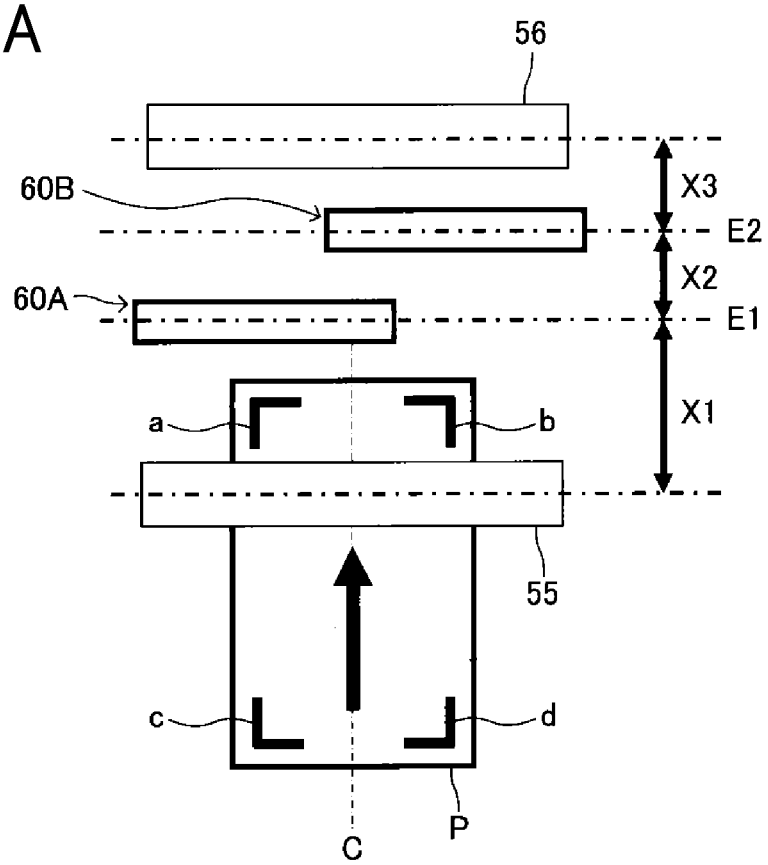
FIGS. 6A and 6B are schematic views illustrating a dimensional relation of the image reading device.

Each of the first and second image reading units 60A and 60B includes a reader 51, an illumination unit 52, and the background member 54 to read an image on the sheet P being conveyed. The second image reading unit 60B is disposed downstream from the first image reading unit 60A in the conveyance direction of the sheet P. Further, as illustrated in FIG. 6A, the first image reading unit 60A is disposed on one side in a width direction of the sheet P, and the second image reading unit 60B is disposed on the other side in the width direction. Hereinafter, the one side (the left side in FIG. 6A) is referred to as a "first side", and the other side (the right side in FIG. 6A) is referred to as a "second side".

In the present embodiment, the first image reading unit 60A and the second image reading unit 60B are arranged at different positions in the width direction, and the scanned images read by each of the first and second image reading units 60A and 60B (the readers 51) are joined (combined) by image processing, thereby obtaining (reading) an output image formed on the sheet P. For example, a second scanned image read by the second image reading unit 60B is shifted to the upstream side in the conveyance direction by a reading interval X2 between the first image reading unit 60A and the second image reading unit 60B, and combined with a first scanned image read by the first image reading unit 60A, thereby obtaining the output image formed on the sheet P in the entire width direction.

In order to read the image seamlessly over the entire width direction by the first and second image reading units 60A and 60B, an end of the first image reading unit 60A on the second side is located on the second side with respect to a center line C indicated by the dotted dashed line in FIG. 6A in the width direction, and an end of the second image reading unit 60B on the first side is located on the first side with respect to the center line C in the width direction. That is, the first image reading unit 60A and the second image reading unit 60B overlap with each other.

As described above, in the present embodiment, a plurality of image reading units (i.e., the first and second image reading units 60A and 60B), which have a normal size (for example, A4 size in the lengthwise direction) and versatility, are provided to read an image on a wide sheet having the maximum size. Therefore, the cost of the apparatus can be reduced as compared with the case in which one wide image reading unit is provided according to the maximum size of the sheet P that can be conveyed by the image forming apparatus 300.

The reader 51 of each of the first and second image reading units 60A and 60B includes an image sensor 51*a*, a lens 51*b*, mirrors 51*c*, 51*d*, and 51*e*, and the like to read an image on the sheet P illuminated by the illumination unit 52.

The first conveyance roller pair 55 and the second conveyance roller pair 56 convey the sheet P at an image reading position by the reader 51 of the first image reading unit 60A where the sheet P is illuminated by the illumination unit 52. Illumination light from the illumination unit 52 of the first image reading unit 60A is reflected by the sheet P and enters the reader 51 of the first image reading unit 60A, thereby reading the sheet P on the first side as the first scanned image.

Similarly, the first conveyance roller pair 55 and the second conveyance roller pair 56 convey the sheet P at an image reading position by the reader 51 of the second image reading unit 60B where the sheet P is illuminated by the illumination unit 52. Illumination light from the illumination unit 52 of the second image reading unit 60B is reflected by the sheet P and enters the reader 51 of the second image reading unit 60B, thereby reading the sheet P on the second side as the second scanned image.

Each reader 51 of the first and second image reading units 60A and 60B starts reading an image with the image sensor 51*a* immediately before the leading end of the sheet P enters the image reading position, and finishes reading the image with the image sensor 51*a* immediately after the trailing end of the sheet P exits the image reading position. As a result, the reader 51 can read the image on the sheet P and the outline of the sheet P for each sheet P.

The background member 54 of each of the first and second image reading units 60A and 60B includes a large-diameter black roller 54*a* having a black outer circumference, a small-diameter black roller 54*b* having a black outer circumference, a large-diameter white roller 54*c* having a white outer circumference, and a small-diameter white roller 54*d* having a white outer circumference (hereinafter, simply referred to as "rollers 54*a*, 54*b*, 54*c*, and 54*d*"). These four rollers 54*a*, 54*b*, 54*c*, and 54*d* are rotatably supported by a rotary support 54*e*. As the rotary support 54*e* rotates, one of the rollers 54*a*, 54*b*, 54*c*, and 54*d* is located at the image reading position. The background member 54 positions the corresponding one of the rollers 54*a*, 54*b*, 54*c*, and 54*d* at the image reading position depending on data of the sheet P that identifies the thickness, the color, and the like of the sheet P, and the operation mode of the image forming system (e.g., difference in conveyance speed).

The gap between the illumination unit 52 and the one of the rollers 54*a*, 54*b*, 54*c*, and 54*d* of the background member 54 at the image reading position is preferably narrow enough to reliably convey the sheet P. Further, the second conveyance roller pair 56 is preferably driven with high accuracy and controlled so that the sheet P does not bend directly under the illumination unit 52. In particular, two types of transport paths, i.e., the reverse path 27 and a sheet ejection path, are disposed, and a curl correction mechanism may be disposed downstream from the second conveyance roller pair 56. Thus, there may be many error factors that deteriorate the conveyance performance downstream from the second conveyance roller pair 56. Therefore, preferably, the conveyance force of the second conveyance roller pair 56 is increased and the rotation unevenness of the second conveyance roller pair 56 is reduced in order to maintain the reading performance.

The first drive conveyance roller 55*a* and the second drive conveyance roller 56*a* are elastic rollers provided with elastic layers, and the first driven conveyance roller 55*b* and the second driven conveyance roller 56*b* are hard rollers such as metal rollers. The first and second driven conveyance rollers 55*b* and 56*b* are movably supported in the direction to contact and separate from the first and second drive conveyance rollers 55*a* and 56*a*, and pressed against the first and second drive conveyance rollers 55*a* and 56*a* by biasing members such as springs, respectively, to form conveyance nips. Note that the first and second driven conveyance rollers 55*b* and 56*b* may be elastic rollers provided with elastic layers, and the first and second drive conveyance rollers 55*a* and 56*a* may be hard rollers such as metal rollers.

Further, in the present embodiment, the first and second driven conveyance rollers 55*b* and 56*b* are arranged on the background member 54 side with respect to the conveyance path 25 of the sheet P. Alternatively, the first and second drive conveyance rollers 55*a* and 56*a* may be arranged on the background member 54 side and the first and second driven conveyance rollers 55*b* and 56*b* may be arranged on the reader 51 side.

A rotary encoder 59 is disposed on one end of the rotation shaft of the first driven conveyance roller 55*b*. The rotary encoder 59 includes an encoder disc and an encoder sensor. The encoder disc is secured onto the rotation shaft of the first driven conveyance roller 55*b* and rotates together with the first driven conveyance roller 55*b*. The encoder sensor detects a slit formed in the encoder disc.

Although the rotary encoder 59 is disposed on the rotation shaft of the first driven conveyance roller 55*b* in the present embodiment, the rotary encoder 59 may be disposed on the rotation shaft of the first drive conveyance roller 55*a*. A driven conveyance roller to which the rotary encoder 59 is attached is preferably a metal roller in order to secure the accuracy of runout of the rotation shaft.

As the first driven conveyance roller 55*b* rotates, a pulse is generated from the rotary encoder 59 on the rotation shaft. A pulse measuring instrument is coupled to the rotary encoder 59, and the number of pulses from the rotary encoder 59 is measured by the pulse measuring instrument.

A stop trigger sensor 57*a* is disposed on the upstream side of the first conveyance roller pair 55 in the conveyance direction, and a start trigger sensor 57*b* is disposed on the downstream side of the first conveyance roller pair 55 in the conveyance direction. The stop trigger sensor 57*a* and the start trigger sensor 57*b* detect the end of the sheet P passing through in the conveyance direction. For example, a transmissive photosensor or reflective photosensor having high detection accuracy of the end of the sheet P is available for the stop trigger sensor 57*a* and the start trigger sensor 57*b*. In the present embodiment, the reflective photosensor is used. The start trigger sensor 57*b* detects the leading end of the sheet P in the conveyance direction. The stop trigger sensor 57*a* detects the trailing end of the sheet P and the rear end of a detection image.

In the present embodiment, the length of the sheet P in the conveyance direction is measured by the stop trigger sensor 57*a*, the start trigger sensor 57*b*, and the rotary encoder 59. Specifically, the length of the sheet P in the conveyance direction is measured as follows. As described above, as the first driven conveyance roller 55*b* rotates, a pulse signal is generated from the rotary encoder 59. When the start trigger sensor 57*b* detects the passage of the leading end of the sheet P, the rotary encoder 59 starts measuring the number of pulses, and when the stop trigger sensor 57*a* detects the passage of the trailing end of the sheet P, the rotary encoder 59 finishes measuring the number of pulses.

The length Lt of the sheet P in the conveyance direction is expressed by the following equation.

$$Lt=A+B+(nx/N)\times\pi\times D1b \qquad \text{Equation 1,}$$

where, D1b represents the diameter of the first driven conveyance roller 55*b* onto which the rotary encoder 59 is attached, N represents the number of pulses of the rotary encoder 59 during one rotation of the first driven conveyance roller 55*b*, and nx represents the number of pulses after the start trigger sensor 57*b* detects the passage of the leading end of the sheet P until the stop trigger sensor 57*a* detects the passage of the trailing end of the sheet P. Further, A represents the conveyance distance from the stop trigger sensor 57*a* to the first conveyance roller pair 55, and B represents the conveyance distance from the first conveyance roller pair 55 to the start trigger sensor 57*b*.

Generally, the conveyance speed of the sheet P fluctuates depending on mechanical tolerances, such as external dimensional tolerances of the roller (in particular, the drive roller) that conveys the sheet P and the runout of the shaft. Accordingly, the pulse cycle and the pulse width of the rotary encoder 59 constantly fluctuate, but the number of pulses does not change. Therefore, the length Lt of the sheet P in the conveyance direction can be obtained without depending on the conveyance speed of the sheet P by Equation 1.

Figure 3:
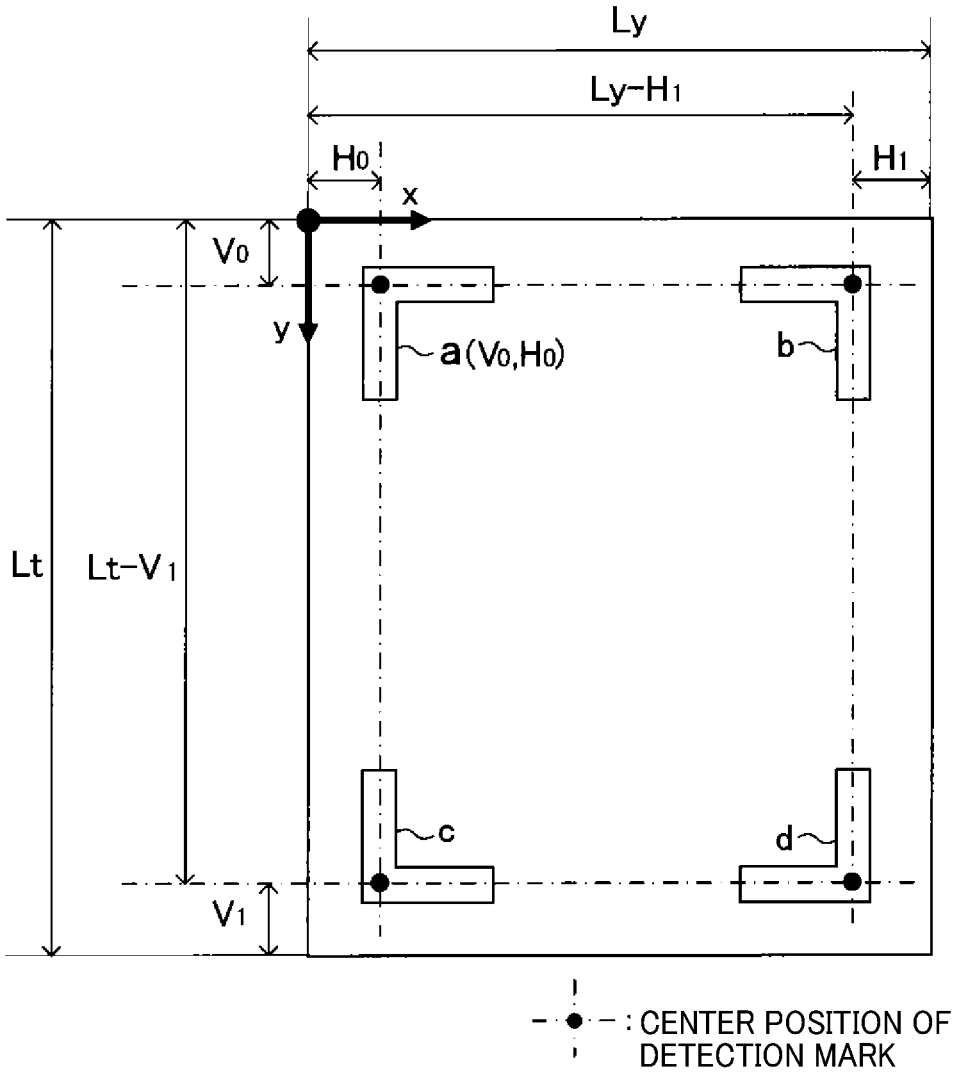
FIG. 3 is a schematic view illustrating an example of a detection pattern formed on a sheet for image alignment according to an embodiment of the present disclosure.

FIG. 3 is a schematic view illustrating an example of a detection pattern formed on the sheet P for image alignment. The image forming apparatus 300 has an adjustment mode to align an image. The image forming apparatus 300 forms L-shaped detection marks a, b, c, and d near the four corners on the sheet P when the adjustment mode is automatically or manually selected. The sheet P on which the detection marks a, b, c, and d have been formed is conveyed to the image reading device 50 via the fixing process by the fixing device 8 and the cooling process by the cooling device 9.

The first conveyance roller pair 55 and the second conveyance roller pair 56 conveys the sheet P in the image reading device 50. The reader 51 of the first image reading unit 60A optically reads the end of the sheet P and the detection marks a and c. The reader 51 of the second image reading unit 60B optically reads the detection marks b and d. Then, a controller 110 (see FIG. 2) calculates the coordinates (e.g., H0, V0) of the center position of each of the detection marks a, b, c, and d on the sheet P based on the composite scanned image obtained by combining the scanned images read by the first and second image reading units 60A and 60B, and the length Lt of the sheet P in the conveyance direction calculated by Equation 1. Specifically, a scale for the scanned image is defined based on the length Lt of the sheet P in the conveyance direction calculated by Equation 1, and the coordinates (e.g., H0, V0) of the center position of each of the detection marks a, b, c, and d are calculated based on the scale. Note that, instead of the L-shaped detection marks a, b, c, and d illustrated in FIG. 3, detection marks having a shape such as a cross, a rectangle, or a straight line may be used.

For example, the coordinate V0 of the front detection mark a in the conveyance direction are obtained as follows. First, the position of the leading end of the sheet P, which is the origin in the conveyance direction, is located. In the present embodiment, in the case of a white sheet P, the black roller (i.e., the large-diameter black roller 54*a* or the small-diameter black roller 54*b*) is positioned at the image reading position, and the image reading is started before the leading end of the sheet P passes through the image reading position. Therefore, the front side of the scanned image is black. In the conveyance direction, the controller 110 detects a position P1 of the edge portion at which the first scanned image read by the first image reading unit 60A turns from black to white first from the front side of the first scanned image. The position P1 detected by the controller 110 corresponds to the leading end of the sheet P, that is, the origin in the conveyance direction. In the present embodiment, the detection marks a, b, c, and d are painted, for example, in solid black as illustrated in FIG. 6A but outlined in FIG. 3 for understanding the coordinates of the center positions of the detection marks a, b, c, and d. The controller 110 detects a position P2 of the edge portion at which the first scanned image turns from white to black, and further, a position P3 of the edge portion at which the first scanned image turns from black to white at the lateral bar portion of the front detection mark a. The position P2 corresponds to the front end of the front detection mark a. The position P3 corresponds to the rear end of the lateral bar portion of the front detection mark a. In FIG. 3, the origin is the upper left corner of the sheet P, and the coordinate V0 in the conveyance direction of the center position of the front detection mark a is obtained by the expression of (P3+P2−2×P1)/2. Similarly, the front detection mark b is disposed on the other side in the width direction and on the front side of the sheet P, and the coordinate of the front detection mark b is obtained from the second scanned image read by the second image reading unit 60B.

The coordinate H0 in the width direction of the center position of the front detection mark a can also be obtained in the same manner. That is, in the width direction, the controller 110 detects a position Pa of the edge portion (i.e., one side end of the sheet P) as the origin in the width direction at which the first scanned image turns from black to white first from one side of the first scanned image. Then, the controller 110 detects a position Pb of the edge portion at which the first scanned image turns from white to black, and further, a position Pc of the edge portion at which the first scanned image turns from black to white at the longitudinal bar portion of the front detection mark a. The position Pb corresponds to the one side end of the longitudinal bar portion of the front detection mark a. The position Pc corresponds to the other side end of the longitudinal bar portion of the front detection mark a. When the origin is the upper left corner of the sheet P in FIG. 3 as described above, the coordinate H0 in the width direction of the center position of the front detection mark a is obtained by the expression of (Pc+Pb−2×Pa)/2. Similarly, the rear detection mark c is disposed on the one side in the width direction and on the rear side of the sheet P, and the coordinate in the width direction of the rear detection mark c is obtained from the first scanned image.

The coordinates in the conveyance direction of the rear detection marks c and d disposed on the rear side of the sheet P in the conveyance direction are obtained as follows. In the conveyance direction, the controller 110 detects a position P4 at which the scanned image (the first scanned image for the detection mark c and the second scanned image for the detection mark d) turns to white from the rear side of the scanned image as the trailing end of the sheet P. Then, the controller 110 detects a position P5 at which the scanned image turns from white to black at the lateral bar portion of the rear detection mark c (or d), and further, a position P6 at which the scanned image turns from black to white. Accordingly, a distance V1 from the trailing end of the sheet P to the center position of the rear detection marks c and d is calculated by the expression of (P6+P5−2×P4)/2. The coordinate (Lt−V1) in the conveyance direction of the center position of the rear detection marks c and d is obtained by subtracting the distance V1 from the length Lt of the sheet P.

The coordinates in the width direction of the detection marks b and d disposed on the other side end of the sheet P in the width direction are obtained as follows. That is, in the width direction, the controller 110 detects a position Pd at which the second scanned image turns to white from the other side of the scanned image as the other side end of the sheet P. Then, the controller 110 detects a position Pe at which the second scanned image turns from white to black, and further, a position Pf at which the second scanned image turns from black to white at the longitudinal bar portion of the detection marks b and d. Accordingly, a distance H1 from the other side end of the sheet P to the center position of the detection marks b and d on the other side in the width direction is calculated by the expression of (Pf+Pe−2×Pd)/2. The coordinate (Ly−H1) in the width direction of the center position of the detection marks b and d is obtained by subtracting the distance H1 from the length Ly of the sheet P in the width direction.

Figure 4:
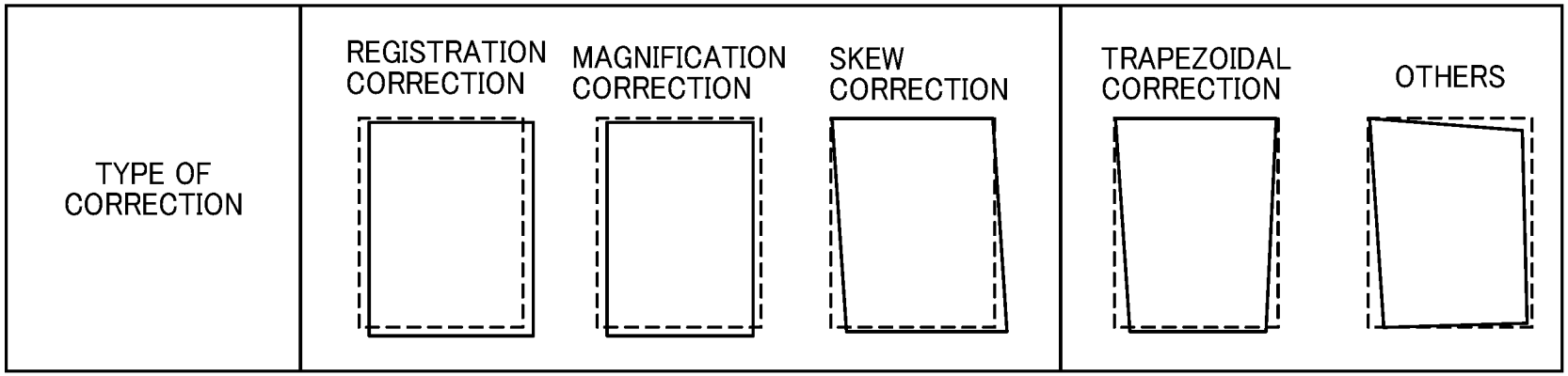
FIG. 4 is a schematic diagram illustrating types of image corrections.

FIG. 4 is a schematic diagram illustrating types of image corrections. The controller 110 calculates the amount of deviation (i.e., correction value) of the calculated center position of each of the detection marks a, b, c, and d from the target position, and corrects the writing timing or position by the exposure device 6 so that each of the detection marks a, b, c, and d is formed at the target position. As illustrated in FIG. 4, the image forming apparatus 300 according to the present embodiment performs various corrections to correct the image position, such as registration correction (that is, correction for translating the image position in the width direction or the conveyance direction of the sheet P), magnification correction, skew correction, trapezoidal correction, and other corrections. The type of correction is not limited to the above examples. These corrections can be performed by any known methods, and detailed description thereof is omitted.

Further, in the present embodiment, the first scanned image read by the first image reading unit 60A and the second scanned image read by the second image reading unit 60B are combined into the composite scanned image. The output image on the sheet P obtained from the composite scanned image is compared with the master image that is the original data of the output image, thereby inspecting the output image. Specifically, the controller 110 generates a difference image indicating the difference between the master image and the output image. Defects (defective pixels) that are not found in the master image remain in the generated difference image. If the number of the defects (defective pixels) is equal to or greater than the threshold, the controller 110 determines that the output image is a defective image. The inspection of the output image can be performed by any known methods, and detailed description thereof is omitted.

Further, in the present embodiment, the controller 110 corrects a gradation reproduction curve based on the full-color output image of the composite scanned image on the sheet P and the master image which is the original data of the output image to prevent the color output on the sheet P from fluctuating. Specifically, the controller 110 calculates the difference between the color of the master image and the color of the output image. Next, the controller 110 determines the amount of correction for correcting the current set value indicating the gradation reproduction curve of the image processing parameter based on the calculated difference. The control to prevent the fluctuation of the output color on the sheet P can be performed by any known methods, and detailed description thereof is omitted.

In the image forming apparatus 300 described above, the sheet P may be expanded or contracted, or deformed by the fixing process, and so-called front-back misregistration may occur in which the images formed on the front surface and the back surface of the sheet P are misaligned with each other.

In addition, due to cutting tolerances of the bundle of sheets P, one end of the sheet P or the other end of the sheet P may be tilted with respect to the conveyance direction. Here, the one end is the leading end of the sheet P and the other end is the trailing end of the sheet P in the conveyance direction when an image is formed on the front surface of the sheet P. When an image is formed on the back surface of the sheet P, the sheet P is reversed in switchback manner and conveyed to the secondary transfer nip again. Therefore, the other end of the sheet P, which is the trailing end of the sheet P in the conveyance direction when an image is formed on the front surface, becomes the leading end of the sheet P in conveyance direction when an image is formed on the back surface.

The leading end of the sheet P in the conveyance direction contacts the registration roller pair 15 before the sheet P is conveyed to the secondary transfer nip. If there are cutting tolerances of the bundle of sheets P, the posture of the sheet P when one end of the sheet P contacts the registration roller pair 15 is different from the posture of the sheet P when the other end of the sheet P contacts the registration roller pair 15. The one end is the leading end in the conveyance direction when an image is formed on the front surface of the sheet P, and the other end is the leading end in the conveyance direction when an image is formed on the back surface of the sheet P. As a result, the posture of the sheet P being conveyed when an image is transferred to the front surface of the sheet P and the posture of the sheet P being conveyed when an image is transferred to the back surface of the sheet P are different from each other. Accordingly, the front and back misregistration may occur due to the cutting tolerances of the bundle of sheet P.

Therefore, the image on the front surface is preferably aligned with the image on the back surface of the sheet P by the above-described corrections. When the images on the front and back surfaces are aligned with each other, the controller 110 causes the image forming apparatus 300 to transfer a detection pattern onto the front surface, fix the detection pattern, cool the sheet P, and read the detection marks on the front surface. In the same order, the controller 110 causes the image forming apparatus 300 to transfer a detection pattern onto the back surface, fix the detection pattern, cool the sheet P, and read the detection marks on the back surface. Then, based on the result of reading the detection patterns on the front and back surfaces, the controller 110 corrects the writing timing and position by the exposure device 6 and/or the image magnification of the image data so that the positions of the images on the front and back surfaces coincide with each other. This configuration can prevent the images on the front and back surfaces from being misaligned with each other.

Figure 5:
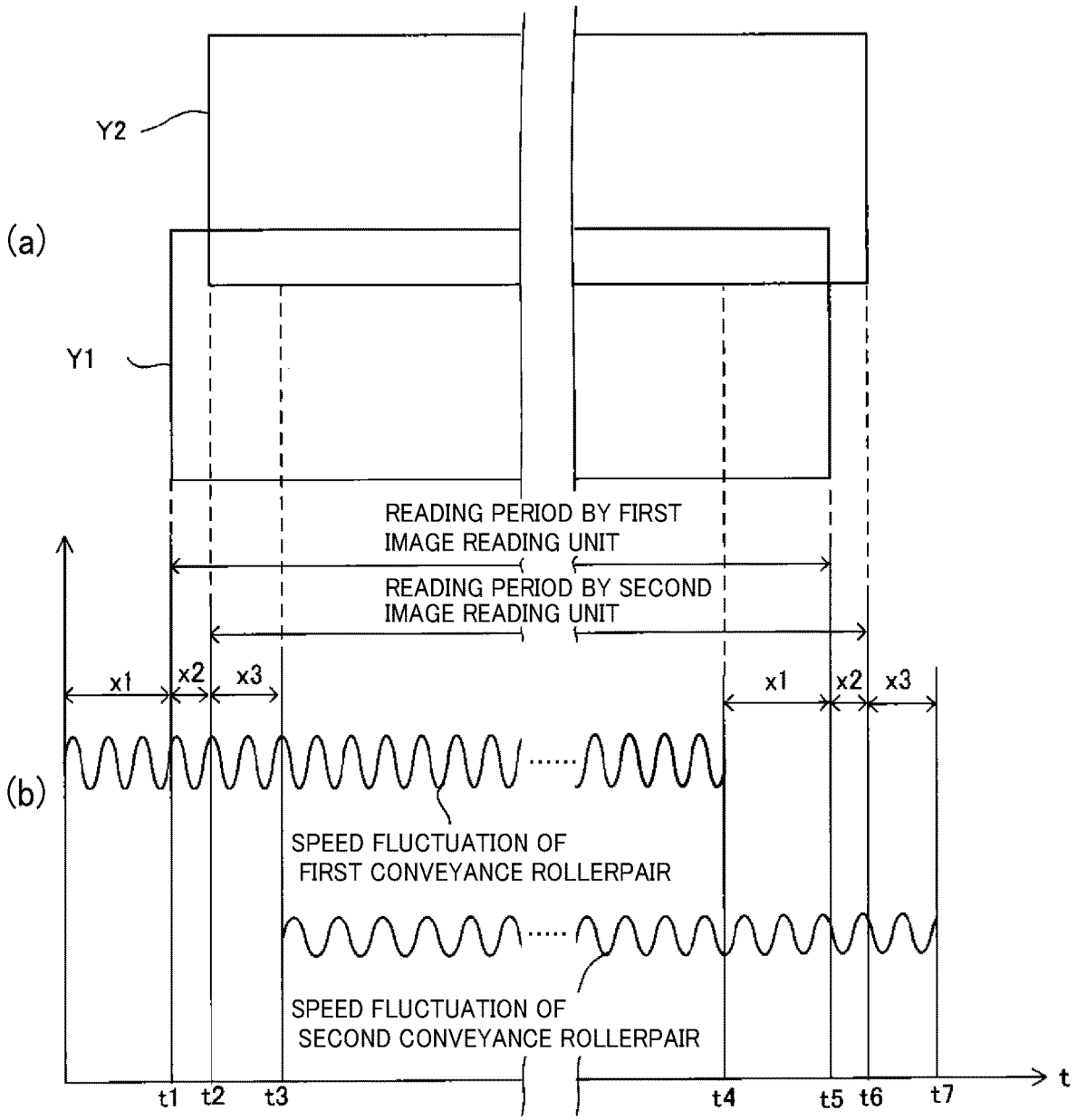
FIG. 5 includes a diagram illustrating a first scanned image read by a first image reading unit and a second scanned image read by a second image reading unit of the image reading device, and a graph illustrating conveyance of the sheet passing through the image reading device.
Figure 6B:
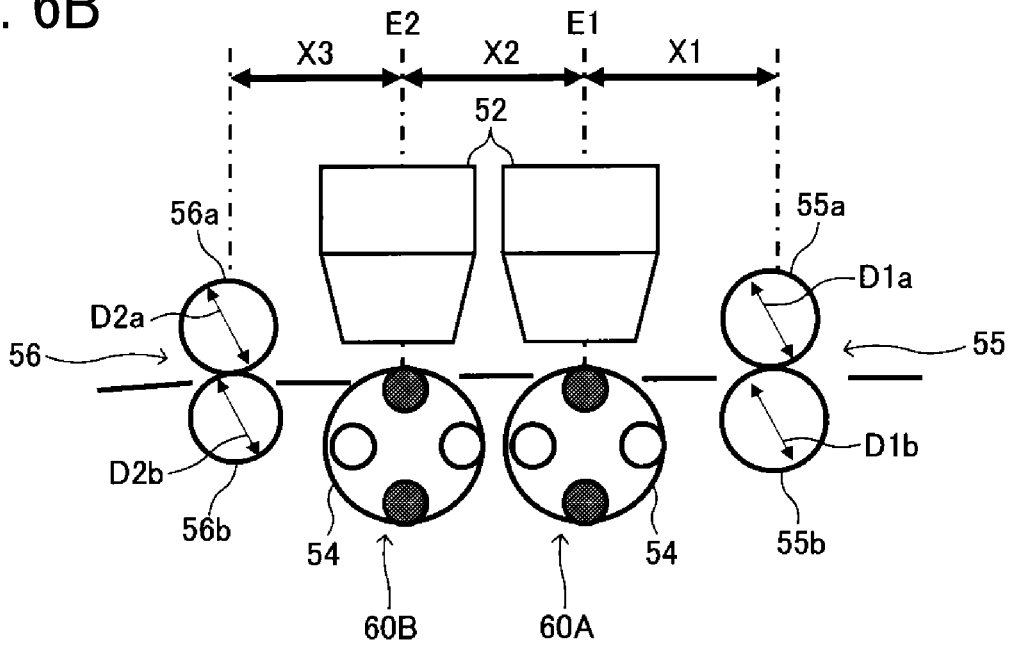

A part (a) of FIG. 5 is a diagram illustrating a first scanned image Y1 read by the first image reading unit 60A and a second scanned image Y2 read by the second image reading unit 60B, and a part (b) of FIG. 5 is a graph illustrating conveyance of the sheet P passing through the image reading device 50. FIGS. 6A and 6B are schematic views illustrating a dimensional relation of the image reading device 50.

In the part (b) of FIG. 5, t1 represents the time when the leading end of the sheet P passes through a first image reading position E1 of the first image reading unit 60A, and t2 represents the time when the leading end of the sheet P passes through a second image reading position E2 of the second image reading unit 60B. In the part (b) of FIG. 5, t3 represents the time when the leading end of the sheet P passes through the second conveyance roller pair 56, and t4 represents the time when the trailing end of the sheet P passes through the first conveyance roller pair 55. Further, in the part (b) of FIG. 5, t5 represents the time when the trailing end of the sheet P passes through the first image reading position E1, and t6 represents the time when the trailing end of the sheet P passes through the second image reading position E2. Furthermore, in the part (b) of FIG. 5, t7 represents the time when the trailing end of the sheet P passes through the second conveyance roller pair 56.

As illustrated in FIG. 5, due to the eccentricity of the first drive conveyance roller 55*a* of the first conveyance roller pair 55, the conveyance speed of the sheet P conveyed to the first and second image reading positions E1 and E2 fluctuates with the rotation cycle of the first drive conveyance roller 55*a* that applies conveyance force to the sheet P. Further, due to the eccentricity of the second drive conveyance roller 56*a* of the second conveyance roller pair 56, the conveyance speed of the sheet P passing through the first and second image reading positions E1 and E2 fluctuates with the rotation cycle of the second drive conveyance roller 56*a* that applies conveyance force to the sheet P.

Until the leading end of the sheet P reaches the second conveyance roller pair 56 (i.e., the time t3 in the part (b) of FIG. 5), the sheet P is conveyed by the first conveyance roller pair 55, and the conveyance speed of the sheet P fluctuates with the rotation cycle of the first drive conveyance roller 55*a*. As a result, due to the fluctuation of the conveyance speed of the first drive conveyance roller 55*a*, the front side of the first scanned image Y1 and the front side of the second scanned image Y2 expand and contract with the rotation cycle of the first drive conveyance roller 55*a*.

Further, after the leading end of the sheet P reaches the second conveyance roller pair 56 (i.e., the time t3 in the part (b) of FIG. 5) until the trailing end of the sheet P passes through the first conveyance roller pair 55 (i.e., the time t4 in the part (b) of FIG. 5), the sheet P is conveyed by the first conveyance roller pair 55 and the second conveyance roller pair 56. At this time, the conveyance speed fluctuates substantially with the rotation cycle of the drive conveyance roller (i.e., the first drive conveyance roller 55*a* or the second drive conveyance roller 56*a*) of one of the first and second conveyance roller pairs 55 and 56 having the stronger conveyance force.

In the present embodiment, as described above, the conveyance force of the second conveyance roller pair 56 is set stronger than the conveyance force of the first conveyance roller pair 55 so that the mechanisms (e.g., the reverse path 27, the sheet ejection path, and the curl correction mechanism) disposed downstream from the second conveyance roller pair 56 in the conveyance direction do not affect the conveyance speed of the sheet P passing through the image reading positions E1 and E2. Therefore, after the leading end of the sheet P reaches the second conveyance roller pair 56 until the trailing end of the sheet P passes through the first conveyance roller pair 55, the conveyance speed fluctuates substantially with the rotation cycle of the second drive conveyance roller 56*a*. Specifically, when the conveyance speed of the sheet P by the second conveyance roller pair 56 is faster than the conveyance speed of the sheet P by the first conveyance roller pair 55, the sheet P slips with respect to the first drive conveyance roller 55*a* and is conveyed at the conveyance speed by the second conveyance roller pair 56. On the other hand, when the conveyance speed of the sheet P by the second conveyance roller pair 56 is slower than the conveyance speed of the sheet P by the first conveyance roller pair 55, the sheet P bends between the second conveyance roller pair 56 and the first conveyance roller pair 55. The bend of the sheet P occurs between the first conveyance roller pair 55 and the first image reading unit 60A because the gap between the illumination unit 42 and background member 54 of the first image reading unit 60A is as narrow as possible. As a result, the sheet P is conveyed substantially at the conveyance speed by the second conveyance roller pair 56 at the first image reading position E1 and the second image reading position E2. Therefore, in the present embodiment, the center portions of the first scanned image Y1 and the second scanned image Y2 expand and contract with the rotation cycle of the second drive conveyance roller 56*a*.

Further, after the trailing end of the sheet P passes through the first conveyance roller pair 55 (i.e., the time t4 in the part (b) of FIG. 5) until the trailing end of the sheet P reaches the first and second image reading positions E1 and E2 (i.e., the times t5 and t6 in the part (b) of FIG. 5), the sheet P is conveyed by the second conveyance roller pair 56, and the conveyance speed of the sheet P fluctuates with the rotation cycle of the second drive conveyance roller 56*a*. Therefore, the rear sides of the first scanned image Y1 and the second scanned image Y2 expand and contract with the rotation cycle of the second drive conveyance roller 56*a*.

As illustrated in the part (a) of FIG. 5, since the first image reading unit 60A is disposed upstream from the second image reading unit 60B by the reading interval X2 in the conveyance direction, the front side of the first scanned image Y1 that expands and contracts with the rotation cycle of the first drive conveyance roller 55*a* is longer than the front side of the second scanned image Y2 by the reading interval X2. Further, the portion of the first scanned image Y1 that expands and contracts with the rotation cycle of the second drive conveyance roller 56*a* is shorter than the portion of the second scanned image Y2 by the reading interval X2.

FIGS. 7A and 7B are graphs illustrating expansion and contraction of the first scanned image and the second scanned image according to a comparative example. FIG. 7A illustrates the expansion and contraction of the first scanned image, and FIG. 7B illustrates the expansion and contraction of the second scanned image.

In the comparative example, the reading interval X2 between the first image reading unit 60A (first image reading position E1) and the second image reading unit 60B (second image reading position E2) is equal to an integral multiple of the circumference of the first drive conveyance roller 55*a* plus half of the circumference of the first drive conveyance roller 55*a*. That is, the reading interval X2 is not an integral multiple of the circumference of the second drive conveyance roller 56*a*. Further, the conveyance force of the second conveyance roller pair 56 is stronger than the conveyance force of the first conveyance roller pair 55, and the amplitude of the fluctuation of the conveyance speed with the rotation cycle of the second drive conveyance roller 56*a* is smaller than the amplitude of the fluctuation of the conveyance speed with the rotation cycle of the first drive conveyance roller 55*a*.

As illustrated in FIGS. 7A and 7B, when the sheet P is conveyed only by the first conveyance roller pair 55, the front side of each of the first and second scanned images expands and contracts with the rotation cycle of the first drive conveyance roller 55*a*. In this example, the reading interval X2 between the first image reading unit 60A and the second image reading unit 60B is equal to an integral multiple of the circumference of the first drive conveyance roller 55*a* plus half of the circumference of the first drive conveyance roller 55*a*. Therefore, the expansion and contraction of the first scanned image illustrated in FIG. 7A with the rotation cycle of the first drive conveyance roller 55*a* is out of phase by half the rotation cycle with the expansion and contraction of the second scanned image illustrated in FIG. 7B with the rotation cycle of the first drive conveyance roller 55*a*. As a result, when the first scanned image and the second scanned image are combined to a composite scanned image, an image deviation occurs between the first scanned image and the second scanned image on the front side of the composite scanned image. The image deviation appears as a vertical streak at the joint between the first scanned image and the second scanned image of the composite scanned image. As a result, when the output image is inspected using the composite scanned image, even though the vertical streak is not generated in the actual output image, the controller 110 may determine that the vertical streak as a defective image is formed on the front side of the output image.

Further, in FIGS. 7A and 7B, the reading interval X2 between the first image reading unit 60A (first image reading position E1) and the second image reading unit 60B (second image reading position E2) is not an integral multiple of the circumference of the second drive conveyance roller 56*a*. Therefore, after the second drive conveyance roller 56*a* starts conveying the sheet P, the expansion and contraction of the first scanned image with the rotation cycle of the second drive conveyance roller 56*a* is out of phase with the expansion and contraction of the second scanned image with the rotation cycle of the second drive conveyance roller 56*a*. As a result, when the first scanned image and the second scanned image are combined to a composite scanned image, the image deviation occurs between the first scanned image and the second scanned image from the center portion to the rear side of the composite scanned image, thereby generating the vertical streak at the joint. Therefore, when the output image is inspected using the composite scanned image, even though the vertical streak is not generated in the actual output image, the controller 110 may determine that the vertical streak as a defective image is formed from the center portion to the rear side of the output image.

Further, if the image deviation between the first scanned image and the second scanned image is large, the color difference of the output image from the master image is larger than the color difference of the actual output image from the master image when the control to prevent the color fluctuation is performed using the composite scanned image. Accordingly, the control to prevent the color fluctuation may not be performed accurately. Furthermore, if the image deviation between the first scanned image and the second scanned image is large, the difference between the positions of the detection mark a and the detection mark b in the conveyance direction on the output image is larger than the actual difference on the actual output image. Accordingly, the skew correction may not be performed accurately.

Therefore, in the present embodiment, the reading interval X2 between the first image reading unit 60A (first image reading position E1) and the second image reading unit 60B (second image reading position E2) satisfies the following relation expressed by Equation 2.

$$X2=n1\times\pi\times D1a \qquad \text{Equation 2,}$$

where D1a represents the diameter of the first drive conveyance roller 55*a*, and n1 is an integer.

Further, the reading interval X2 between the first image reading unit 60A (first image reading position E1) and the second image reading unit 60B (second image reading position E2) satisfies the following relation expressed by Equation 3.

$$X2=n2\times\pi\times D2a \qquad \text{Equation 3,}$$

where D2a represents the diameter of the second drive conveyance roller 56*a*, and n2 is an integer.

Figures 8A, 8B:
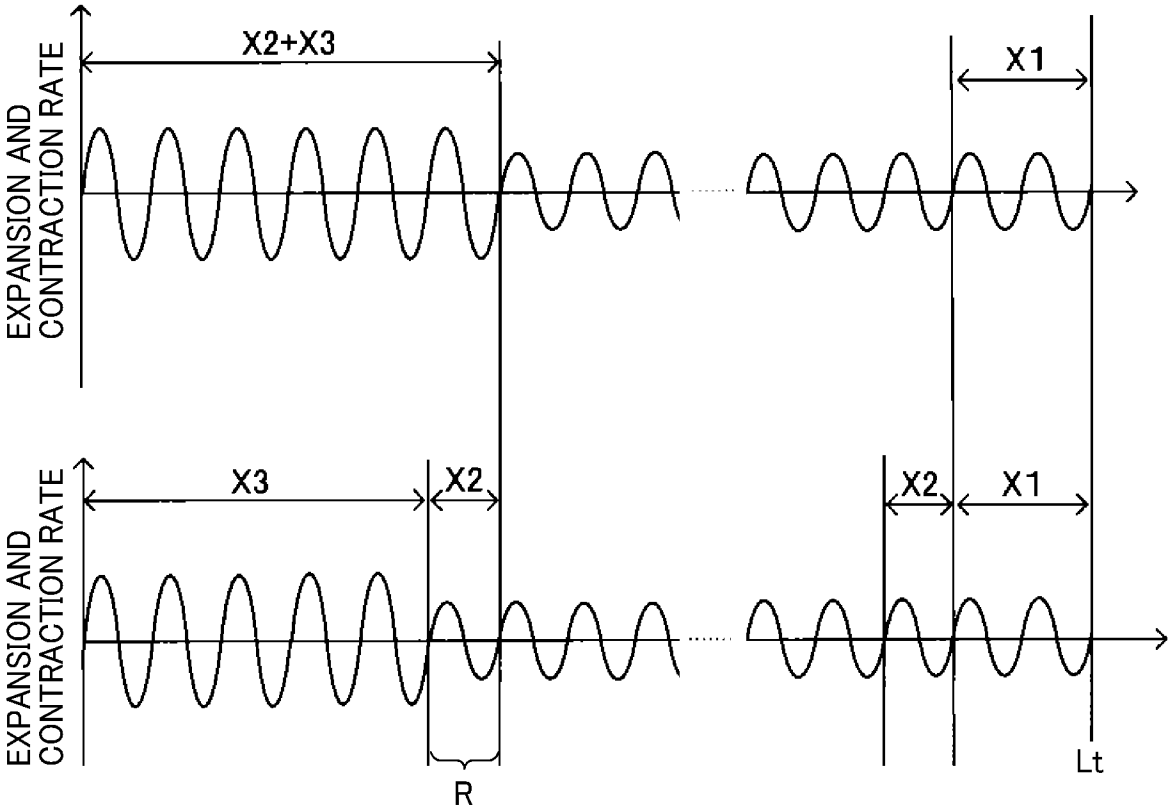
FIGS. 8A and 8B are graphs illustrating expansion and contraction of the first scanned image and the second scanned image according to an embodiment of the present disclosure.

FIGS. 8A to 8B are graphs illustrating expansion and contraction of the first and second scanned images according to the present embodiment. FIG. 8A illustrates the expansion and contraction of the first scanned image, and FIG. 8B illustrates the expansion and contraction of the second scanned image.

In the present embodiment, as expressed in Equation 2, the reading interval X2 between the first image reading unit 60A (first image reading position E1) and the second image reading unit 60B (second image reading position E2) is an integral multiple of the circumference (π×D1a) of the first drive conveyance roller 55*a*. Accordingly, the expansion and contraction on the front side of the first scanned image illustrated in FIG. 8A with the rotation cycle of the first drive conveyance roller 55*a* is in phase with the expansion and contraction on the front side of the second scanned image illustrated in FIG. 8B with the rotation cycle of the first drive conveyance roller 55*a*. Therefore, when the first scanned image and the second scanned image are combined to a composite scanned image, an image deviation does not occur on the front side of the composite scanned image, and the vertical streak is not generated at the joint between the first scanned image and the second scanned image on the front side of the composite scanned image.

Further, in the present embodiment, as expressed in Equation 3, the reading interval X2 between the first image reading unit 60A (first image reading position E1) and the second image reading unit 60B (second image reading position E2) is an integral multiple of the circumference (π×D2a) of the second drive conveyance roller 56*a*. Accordingly, the expansion and contraction from the center portion to the rear side of the first scanned image illustrated in FIG. 8A with the rotation cycle of the second drive conveyance roller 56*a* is in phase with the expansion and contraction from the center portion to the rear side of the second scanned image illustrated in FIG. 8B with the rotation cycle of the second drive conveyance roller 56*a*. Therefore, when the first scanned image and the second scanned image are combined to a composite scanned image, an image deviation does not occur from the center portion to the rear side of the composite scanned image. As a result, the vertical streak is not generated at the joint between the first scanned image and the second scanned image from the center portion to the rear side of the composite scanned image.

As described above, in the present embodiment, the output image can be inspected accurately using the composite scanned image without generating the vertical streaks at the joint between the first scanned image and the second scanned image of the composite scanned image. Further, since the image deviation between the first scanned image and the second scanned image is prevented, the color difference of the output image from the master image does not become larger than the color difference of the actual output image from the master image. Accordingly, the control to prevent the color fluctuation can be performed accurately. Furthermore, the difference between the positions of the detection mark a and the detection mark b in the conveyance direction on the output image does not become larger than the actual difference on the actual output image. Accordingly, the skew correction can be performed accurately.

Further, the reading interval X2 preferably satisfies the following relation expressed by Equation 4.

$$X2=n3\times\pi\times D1b \qquad \text{Equation 4,}$$

where D1b represents the diameter of the first driven conveyance roller 55*b*, and n3 is an integer.

In the present embodiment, the nip pressure of the first conveyance roller pair 55 is increased so that the cooling device 9 disposed upstream from the first conveyance roller pair 55 in the conveyance direction does not affect the conveyance of the sheet P passing through the image reading positions E1 and E2. The first drive conveyance roller 55*a* has the elastic layer, and the first driven conveyance roller 55*b* is the metal roller. Therefore, in the nip, the outer circumferential surface of the first drive conveyance roller 55*a* is deformed according to the curvature of the first driven conveyance roller 55*b*. Due to the eccentricity of the first driven conveyance roller 55*b*, the radius of curvature at the nip may change, and the conveyance speed of the sheet P may fluctuate with the rotation cycle of the first driven conveyance roller 55*b*. When the conveyance speed of the sheet P fluctuates with the rotation cycle of the first driven conveyance roller 55*b*, the first scanned image and the second scanned image expand and contract with the rotation cycle of the first driven conveyance roller 55*b*. Accordingly, the image deviation occurs between the first scanned image and the second scanned image due to the fluctuation of the conveyance speed with the rotation cycle of the first driven conveyance roller 55*b*. As a result, the inspection of the output image, the control to prevent the color fluctuation, the skew correction, and the like may be adversely affected.

By satisfying the relation expressed by Equation 4 described above, the expansion and contraction of the first scanned image with the rotation cycle of the first driven conveyance roller 55*b* is in phase with the expansion and contraction of the second scanned image with the rotation cycle of the first driven conveyance roller 55*b*. Accordingly, the image deviation due to the fluctuation of the conveyance speed with the rotation cycle of the first driven conveyance roller 55*b* is prevented between the first scanned image and the second scanned image. As a result, the accuracy of the inspection of the output image, the accuracy of the control to prevent the color fluctuation, the accuracy of the skew correction, and the like can be further improved.

Similarly, the reading interval X2 preferably satisfies the following relation expressed by Equation 5.

$$X2=n4\times\pi\times D2b \qquad \text{Equation 5,}$$

where D2b represents the diameter of the second driven conveyance roller 56*b*, and n4 is an integer.

Also in the second conveyance roller pair 56, the second drive conveyance roller 56*a* has the elastic layer, and the second driven conveyance roller 56*b* is the metal roller. Further, as described above, the nip pressure of the second conveyance roller pair 56 is increased so that the mechanisms disposed downstream from the second conveyance roller pair 56 in the conveyance direction does not affect the conveyance of the sheet P passing through the first and second image reading positions E1 and E2, thereby enhancing the conveyance force. As a result, the outer circumferential surface of the second drive conveyance roller 56*a* is deformed according to the curvature of the second driven conveyance roller 56*b* in the nip of the second conveyance roller pair 56. Therefore, due to the eccentricity of the second driven conveyance roller 56*b*, the radius of curvature at the nip may change, and the conveyance speed of the sheet P may fluctuate with the rotation cycle of the second driven conveyance roller 56*b*. As a result, the image deviation due to the fluctuation of the conveyance speed with the rotation cycle of the second driven conveyance roller 56*b* occurs between the first scanned image and the second scanned image. Thus, the inspection of the output image, the control to prevent the color fluctuation, the skew correction, and the like may be adversely affected.

By satisfying the relation expressed by Equation 5 described above, the expansion and contraction of the first scanned image with the rotation cycle of the second driven conveyance roller 56*b* is in phase with the expansion and contraction of the second scanned image with the rotation cycle of the second driven conveyance roller 56*b*. Accordingly, the image deviation due to the fluctuation of the conveyance speed with the rotation cycle of the second driven conveyance roller 56*b* is prevented between the first scanned image and the second scanned image. As a result, the accuracy of the inspection of the output image, the accuracy of the control to prevent the color fluctuation, the accuracy of the skew correction, and the like can be further improved.

Further, preferably, the diameter D2a of the second drive conveyance roller 56*a* is the same as the diameter D1a of the first drive conveyance roller 55*a*, and the cyclic fluctuation of the first drive conveyance roller 55*a* is in phase with the cyclic fluctuation of the second drive conveyance roller 56*a* when the leading end of the sheet P reaches the second conveyance roller pair 56. This is because the sheet P may be greatly bent or stretched between the first conveyance roller pair 55 and the second conveyance roller pair 56 if the speed difference between the fluctuation of the conveyance speed with the rotation cycle of the first drive conveyance roller 55*a* and the fluctuation of the conveyance speed with the rotation cycle of the second drive conveyance roller 56*a* is large when the sheet P is conveyed by the first conveyance roller pair 55 and the second conveyance roller pair 56. Therefore, the output image may not be read accurately.

In the present embodiment, since the fluctuation of the conveyance speed with the rotation cycle of the first drive conveyance roller 55*a* is in phase with the fluctuation of the conveyance speed with the rotation cycle of the second drive conveyance roller 56*a* when the leading end of the sheet P reaches the second conveyance roller pair 56, the speed difference between the conveyance speed by the first drive conveyance roller 55*a* and the conveyance speed by the second drive conveyance roller 56*a* can be small when the sheet P is conveyed by the first conveyance roller pair 55 and the second conveyance roller pair 56. Therefore, the sheet P is not greatly bent or stretched between the first conveyance roller pair 55 and the second conveyance roller pair 56, thereby preventing the reading accuracy from deteriorating. As a result, the inspection of the output image and the control to prevent the color fluctuation can be performed with high accuracy.

Further, in the region R illustrated in FIGS. 7A and 7B, the first scanned image expands and contracts according to the fluctuation of the conveyance speed with the rotation cycle of the first drive conveyance roller 55*a*, but the second scanned image expands and contracts according to the fluctuation of the conveyance speed with the rotation cycle of the second drive conveyance roller 56*a*. In the present embodiment, since the diameter D2a of the second drive conveyance roller 56*a* is the same as the diameter D1a of the first drive conveyance roller 55*a*, and the cyclic fluctuation of the first drive conveyance roller 55*a* is in phase with the cyclic fluctuation of the second drive conveyance roller 56*a* when the leading end of the sheet P reaches the second conveyance roller pair 56, the image deviation between the first scanned image and the second scanned image in the region R can be prevented as illustrates in FIGS. 8A and 8B. Therefore, in the region R, the image deviation that causes the vertical streak to be generated at the joint between the first scanned image and the second scanned image in the composite scanned image does not occur.

In the present embodiment, each of the diameter D1b of the first driven conveyance roller 55*b*, the diameter D2a of the second drive conveyance roller 56*a*, and the diameter D2b of the second driven conveyance roller 56*b* is an integral multiple of the diameter D1a of the first drive conveyance roller 55*a*, thereby reliably satisfying the relations expressed by Equations 2 to 5 described above.

Further, preferably, the distance X1 from the first conveyance roller pair 55 to the first image reading position E1 is an integral multiple of the circumference of the first drive conveyance roller 55*a* (i.e., $X1=na\times\pi\times D1a$, where na is an integer), and the distance X3 from the second image reading position E2 to the second conveyance roller pair 56 is an integral multiple of the circumference of the first drive conveyance roller 55*a* (i.e., $X3=nb\times\pi\times D1a$, where nb is an integer), resulting in the distance from the first conveyance roller pair 55 to the second conveyance roller pair 56 (i.e., $X1+X2+X3$) being an integral multiple of the circumference of the first drive conveyance roller 55*a*.

By setting the distance from the first conveyance roller pair 55 to the second conveyance roller pair 56 to an integral multiple of the circumference of the first drive conveyance roller 55*a*, the cyclic fluctuation of the first drive conveyance roller 55*a* can be easily in phase with the cyclic fluctuation of the second drive conveyance roller 56*a* when the leading end of the sheet P reaches the second conveyance roller pair 56. That is, the image reading device 50 is assembled so that the cyclic fluctuation of the first drive conveyance roller 55*a* is in phase with the cyclic fluctuation of the second drive conveyance roller 56*a*. After that, by just matching the drive start and drive stop timing between of the first drive conveyance roller 55*a* and the second drive conveyance roller 56*a*, the cyclic fluctuation of the first drive conveyance roller 55*a* can be in phase with the cyclic fluctuation of the second drive conveyance roller 56*a* when the leading end of the sheet P reaches the second conveyance roller pair 56.

Further, by setting the distance X1 from the first conveyance roller pair 55 to the first image reading position E1 to an integral multiple of the circumference of the first drive conveyance roller 55*a* (i.e., $X1=na\times\pi\times D1$ a, where na is an integer), the timing at which the leading end of the sheet P passes through the first image reading position E1 can be stabilized, and the reading accuracy can be stabilized. Further, by setting the distance X1 from the first conveyance roller pair 55 to the first image reading position E1 to an integral multiple of the circumference of the first driving conveyance roller 55*a*, the distance from the first conveyance roller pair 55 to the second image reading position E2 (i.e., $X1+X2$) is also an integral multiple of the circumference of the first drive conveyance roller 55*a*. Therefore, the timing at which the leading end of the sheet P passes through the second image reading position E2 can be stabilized, and the reading accuracy can be stabilized.

Figure 9:
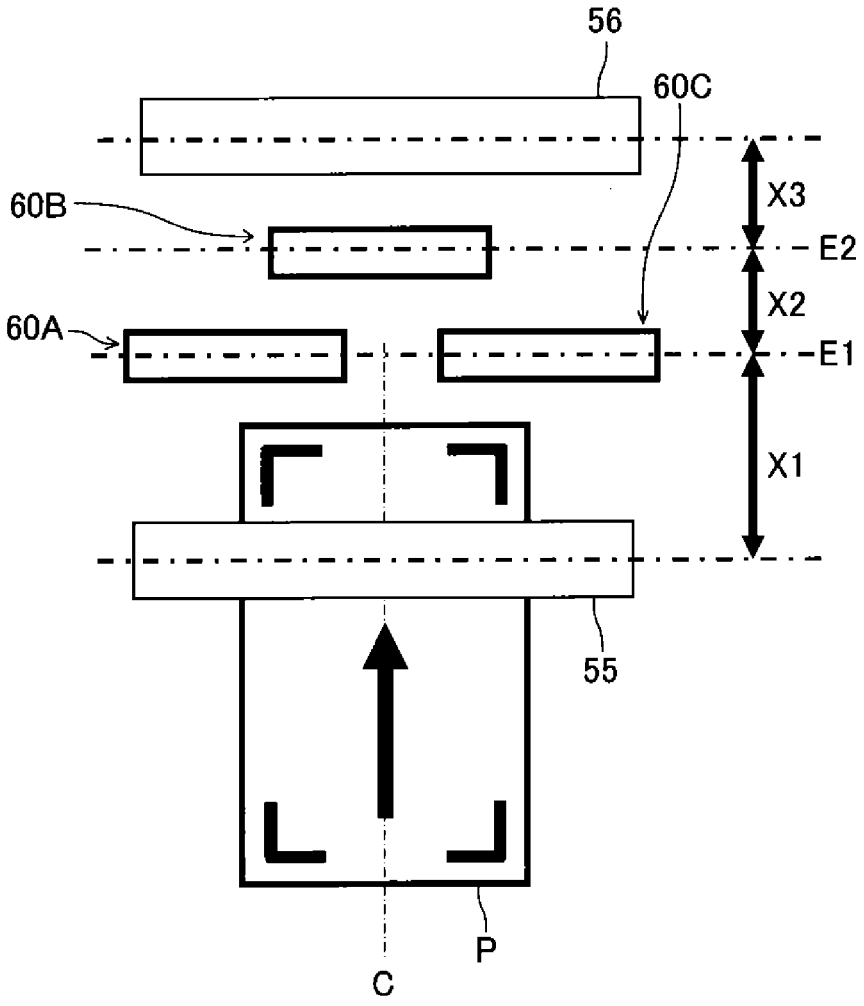
FIG. 9 is a plan view of an image reading device according to a variation.

FIG. 9 is a plan view illustrating a variation of the image reading device 50. The image reading device 50 according to the variation includes three image reading units 60A, 60B, and 60C disposed in a staggered arrangement. The first image reading unit 60A on the first side in the width direction and the third image reading unit 60C on the second side in the width direction are disposed at the same position in the conveyance direction, and the second image reading unit 60B at the center in the width direction is disposed downstream from the first and third image reading units 60A and 60C by the reading interval X2 in the conveyance direction. The second scanned image read by the second image reading unit 60B is shifted to the upstream in the conveyance direction by the reading interval X2 between the first and third image reading units 60A and 60C and the second image reading unit 60B, and combined with the first and third scanned images read by the first and third image reading units 60A and 60C. Thus, the output image formed on the sheet P in the entire width direction is obtained. In the image reading device 50 according to the variation, by satisfying the relations expressed by Equations 2 to 5, the image deviation between the second scanned image and the first and third scanned images can be prevented. Accordingly, the inspection of the output image and the control to prevent the color fluctuation can be performed with high accuracy.

Figure 10:
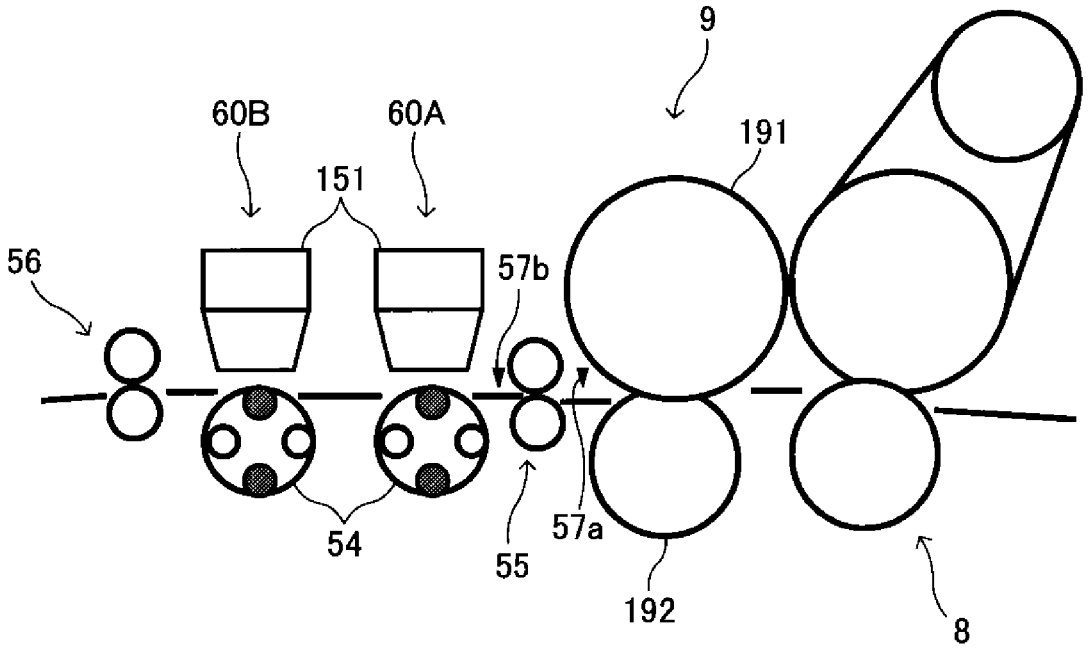
FIG. 10 is a schematic view illustrating a configuration of a conveyance device including a fixing device, a cooling device, and an image reading device according to another variation.

FIG. 10 is a schematic view illustrating a configuration of a conveyance device including the fixing device 8, the cooling device 9, and the image reading device 50 according to another (second) variation. In the conveyance device according to the second variation, the cooling device 9 includes, for example, a cooling roller 191 including a heat pipe and a pressure roller 192 that presses the sheet P against the cooling roller 191. Further, in the conveyance device according to the variation, the image reading device 50 includes the first image reading unit 60A and the second image reading unit 60B that are an equal magnification optical system such as a contact image sensor (CIS) 151. Other configurations are the same as the above-described embodiment. Thus, the conveyance device according to the second variation can be downsized as compared with the conveyance device including the first image reading unit 60A and the second image reading unit 60B that are a reduced optical system such a charge-coupled device (CCD) as illustrated in FIG. 2.

Further, in the present embodiment, the reading interval X2 between the first image reading unit 60A (first image reading position E1) and the second image reading unit 60B (second image reading position E2) is, but is not limited to, an integral multiple of the circumferences of both the first drive conveyance roller 55*a* and the second drive conveyance roller 56*a*. For example, the second conveyance roller pair 56 may be driven to rotate with high accuracy so that the conveyance speed does not fluctuate, and only the relation expressed by Equation 2 described above may be satisfied. Even in such a configuration, on the front side of the composite scanned image, the expansion and contraction of the first scanned image and the second scanned image are in phase with each other, thereby preventing the image deviation between the first scanned image and the second scanned image. From the center portion to the rear side of the composite scanned image, the second conveyance roller pair 56 with high accuracy prevents the expansion and contraction with the rotation cycle of the second drive conveyance roller 56*a*, thereby preventing the image deviation between the first scanned image and the second scanned image. With such a configuration, the cost increase of the apparatus can be reduced, and the image deviation can be prevented as compared with the case in which both the first conveyance roller pair 55 and the second conveyance roller pair 56 are driven to rotate with high accuracy.

On the other hand, in the above-described embodiments, since the reading interval X2 satisfies both Equations 2 and 3 described above, the cost increase of the apparatus can be further reduced. Alternatively, the first conveyance roller pair 55 may be driven to rotate with high accuracy so that the conveyance speed does not fluctuate, and only the relation expressed by Equation 3 described above may be satisfied.

In the present embodiment, as expressed by Equations 2 to 5, the reading interval X2 is just an integral multiple of the circumference of the respective rollers (i.e., the first and second drive conveyance roller 55*a* and 56*a*, and the first and second driven conveyance roller 55*b* and 56*b*). Such a configuration is most preferable. However, in consideration of the manufacturing tolerances of the respective rollers, the reading interval X2 allows ±5% error of the length obtained by an integral multiple of the circumference of the respective rollers. For example, an integer n1 can be replaced with an integer n1' in Equation 2, where $0.95 \times n1 \leq n1' \leq 1.05 \times n1$. The same applies to integers n2, n3 and n4 in Equations 3 to 5. The value of "an integral multiple" in the present embodiment is not limited to only just the value of an integral multiple and is defined so as to allow ±5% error of the value of an integral multiple.

The above descriptions concern about the electrophotographic image forming apparatus 300, but the present disclosure can be applied to an inkjet image forming apparatus. Further, in the above embodiments, the image reading device 50 is arranged in the image forming apparatus 300, but the image reading device 50 may be coupled to the image forming apparatus 300 and the sheet P may be conveyed from the image forming apparatus 300 to the image reading device 50. The present disclosure is also applicable to an image reading device including an automatic document feeder (ADF).

The embodiments described above are examples and can provide, for example, the following effects, respectively.

Aspect 1

An image reading device includes a plurality of image reading units and a conveyance roller pair such as the first conveyance roller pair 55. The plurality of image reading units is arranged at different positions in a width direction perpendicular to a conveyance direction of a recording medium such as the sheet P to read an image on the recording medium at image reading positions. The plurality of image reading units includes an upstream image reading unit such as the first image reading unit 60A and a downstream image reading unit such as the second image reading unit 60B downstream from the upstream image reading unit in the conveyance direction. The conveyance roller pair conveys the recording medium to the plurality of image reading units and includes a drive roller such as the first drive conveyance roller 55*a* and a driven roller such as the first driven conveyance roller 55*b* that contacts the drive roller and rotates following the drive roller. The drive roller has a diameter so that a reading interval between the image reading positions of the upstream image reading unit and the downstream image reading unit is an integral multiple of a circumference of the drive roller.

When the scanned images read by the plurality of image reading units are combined into a single image, an abnormal image such as a vertical streak may be generated at a portion corresponding to the joint of the scanned images by the following reason. That is, the conveyance speed of the recording medium fluctuates with the rotation cycle of the drive rollers due to the eccentricity of the drive roller of the conveyance roller pair conveying the recording medium. Until the leading end of the recording medium reaches another (second) conveyance roller pair, the recording medium is conveyed by the (first) conveyance roller pair, and the conveyance speed of the recording medium fluctuates with the rotation cycle of the (first) drive roller. As a result, the front side of an upstream scanned image read by the upstream image reading unit and the front side of a downstream scanned image read by the downstream image reading unit expand and contract with the rotation cycle of the first drive roller. Accordingly, when the leading end of the recording medium of the upstream scanned image is aligned with the leading end of the recording medium of the downstream scanned image to form a composite scanned image, an image deviation occurs in the image portion in which the expansion and contraction of the upstream scanned image is out of phase with the expansion and contraction of the downstream scanned image, thereby generating the vertical streak.

Therefore, in Aspect 1, the reading interval between the image reading position of the upstream image reading unit and the image reading position of the downstream image reading unit is an integral multiple of the circumference of the first drive roller.

Since the reading interval is an integral multiple of the circumference of the first drive roller, the expansion and contraction on the front side of the upstream scanned image is in phase with the expansion and contraction on the front side of the downstream scanned image. Therefore, when the upstream scanned image and the downstream scanned image are combined into a composite scanned image, the image deviation does not occur between the front side of the upstream scanned image and the front side of the downstream scanned image of the composite scanned image, and the abnormal image such as the vertical streak is not generated on the front side of the composite scanned image.

Further, when the conveyance force of the first conveyance roller pair is stronger than the conveyance force of the second conveyance roller pair, the expansion and contraction of the upstream scanned image can be in phase with the expansion and contraction of the downstream scanned image in the center portion of the composite scanned image. As a result, the abnormal image such as the vertical streak in the center portion of the composite scanned image can be prevented.

As described above, by setting the diameter of the first drive roller so that the reading interval is an integral multiple of the circumference of the first drive roller, the abnormal image such as the vertical streak is prevented from being generated on at least one of the front side and the rear side of the composite scanned image.

Aspect 2

In Aspect 1, the image reading device further includes another (second) conveyance roller pair such as the second conveyance roller pair 56 to convey the recording medium passing through the plurality of image reading units. The second conveyance roller pair includes another (second) drive roller such as the second drive conveyance roller 56*a* and another (second) driven roller such as the second driven conveyance roller 56*b* that contacts the second drive roller and rotates following the second drive roller. The second drive roller has a diameter so that the reading interval is an integral multiple of a circumference of the second drive roller.

After the trailing end of the recording medium has passed through the first conveyance roller pair, the conveyance speed of the recording medium fluctuates with the rotation cycle of the second drive roller. As a result, the rear sides of the upstream scanned image and the downstream scanned image expand and contract with the rotation cycle of the second drive roller.

According to Aspect 2, since the reading interval is an integral multiple of the circumference of the second drive roller, the expansion and contraction on the rear side of the upstream scanned image is in phase with the expansion and contraction on the rear side of the downstream scanned image. Therefore, when the upstream scanned image and the downstream scanned image are combined into a composite scanned image, the image deviation does not occur between the rear side of the upstream scanned image and the rear side of the downstream scanned image of the composite scanned image, and the vertical streak is not generated on the rear side of the composite scanned image.

Further, when the conveyance force of the second conveyance roller pair is stronger than the conveyance force of the first conveyance roller pair, the expansion and contraction of the upstream scanned image can be in phase with the expansion and contraction of the downstream scanned image in the center portion of the composite scanned image. As a result, the abnormal image such as the vertical streak in the center portion of the composite scanned image can be prevented.

Aspect 3

In Aspect 2, the second driven roller such as the second driven conveyance roller 56*b* has a diameter so that the reading interval is an integral multiple of a circumference of the second driven roller.

With this configuration, as described in the above embodiments, the expansion and contraction of the upstream scanned image such as the first scanned image with the rotation cycle of the second driven roller can be in phase with the expansion and contraction of the downstream scanned image such as the second scanned image with the rotation cycle of the second driven roller. As a result, the image deviation due to the fluctuation of the conveyance speed with the rotation cycle of the second driven roller is prevented between the upstream scanned image and the downstream scanned image of the composite scanned image.

Aspect 4

In any one of Aspect 2 or 3, the second drive roller such as the second drive conveyance roller 56*a* has the diameter same as the diameter of the first drive roller such as the first drive conveyance roller 55*a*, and a fluctuation of a conveyance speed of the recording medium with a rotation cycle of the first drive roller is in phase with a fluctuation of a conveyance speed of the recording medium with a rotation cycle of the second drive roller.

With this configuration, as described in the above embodiments, when the recording medium such as the sheet P is conveyed by the first conveyance roller pair and the second conveyance roller pair, the speed difference can be reduced between the fluctuation of the conveyance speed with the rotation cycle of the first drive roller and the fluctuation of the conveyance speed with the rotation cycle of the second drive roller. As a result, the sheet P is not bent or stretched between the first conveyance roller pair and the second conveyance roller pair, thereby reading an image on the recording medium accurately.

Aspect 5

In Aspect 4, a distance from the first conveyance roller pair such as the first conveyance roller pair 55 to the second conveyance roller pair such as the second conveyance roller pair 56 is an integral multiple of the circumference of the first drive roller such as the first drive conveyance roller 55*a*.

As described in the above embodiments, the image reading device is assembled so that the cyclic fluctuation of the first drive roller such as the first drive conveyance roller 55*a* is in phase with the cyclic fluctuation of the second drive roller such as the second drive conveyance roller 56*a*. After that, by matching the drive start and drive stop timing between of the first drive roller and the second drive roller, the fluctuation of the conveyance speed of the recording medium with the rotation cycle of the first drive roller can be in phase with the fluctuation of the conveyance speed of the recording medium with the rotation cycle of the second drive roller.

Aspect 6

In any one of Aspects 1 to 5, the first driven roller such as the first driven conveyance roller 55*b* has a diameter so that the reading interval is an integral multiple of a circumference of the first driven roller.

With this configuration, as described in the above embodiments, the expansion and contraction of the upstream scanned image such as the first scanned image with the rotation cycle of the first driven roller can be in phase with the expansion and contraction of the downstream scanned image such as the second scanned image with the rotation cycle of the first driven roller. As a result, the image deviation due to the fluctuation of the conveyance speed with the rotation cycle of the first driven roller is prevented between the upstream scanned image and the downstream scanned image of the composite scanned image.

Aspect 7

In any one of Aspects 1 to 6, the first driven roller such as the first driven conveyance roller 55*b* is configured to measure a length of the recording medium such as the sheet P in the conveyance direction with a measuring instrument such as the rotary encoder 59.

With this configuration, as described in the above embodiments, the length of the recording medium can be measured with high accuracy even if the conveyance speed of the recording medium fluctuates.

Aspect 8 In any one of Aspects 1 to 7, a distance from the first conveyance roller pair such as the first conveyance roller pair 55 to each of the image reading positions of the plurality of image reading units is an integral multiple of the circumference of the first drive roller.

With this configuration, as described in the above embodiments, the leading end of the recording medium passes through the image reading positions at a predetermined timing, thereby stabilizing the reading accuracy.

Aspect 9

An image reading device includes a plurality of image reading units and a (second) conveyance roller pair. The plurality of image reading units is arranged at different positions in a width direction perpendicular to a conveyance direction of a recording medium to read an image on the recording medium at image reading positions. The plurality of image reading units includes an upstream image reading unit and a downstream image reading unit downstream from the upstream image reading unit in the conveyance direction. The conveyance roller pair conveys the recording medium passing through the plurality of image reading units and includes a (second) drive roller and a (second) driven roller that contacts the drive roller and rotates following the drive roller. The drive roller has a diameter so that a reading interval between the image reading positions of the upstream image reading unit and the downstream image reading unit is an integral multiple of a circumference of the drive roller.

With this configuration, since the reading interval is an integral multiple of the circumference of the second drive roller, the expansion and contraction with the rotation cycle of the second drive roller on the rear side of the upstream scanned image is in phase with the expansion and contraction with the rotation cycle of the second drive roller on the rear side of the downstream scanned image. Therefore, when the upstream scanned image and the downstream scanned image are combined into a composite scanned image, the image deviation does not occur between the rear side of the upstream scanned image and the rear side of the downstream scanned image of the composite scanned image, and the abnormal image such as the vertical streak is not generated on the rear side of the composite scanned image.

Further, when the conveyance force of the second conveyance roller pair is stronger than the conveyance force of the first conveyance roller pair, the expansion and contraction of the upstream scanned image can be in phase with the expansion and contraction of the downstream scanned image in the center portion of the composite scanned image. As a result, the abnormal image such as the vertical streak in the center portion of the composite scanned image can be prevented.

Aspect 10

An image reading device includes a plurality of image reading units, a first conveyance roller pair such as the first conveyance roller pair 55, and a second conveyance roller pair such as the second conveyance roller pair 56. The plurality of image reading units is arranged at different positions in a width direction perpendicular to a conveyance direction of a recording medium to read an image on the recording medium at image reading positions. The plurality of image reading units includes an upstream image reading unit and a downstream image reading unit downstream from the upstream image reading unit in the conveyance direction. The first conveyance roller pair is disposed upstream from the plurality of image reading units to convey the recording medium. The first conveyance roller pair includes a first drive roller such as the first drive conveyance roller 55*a* and a first driven roller such as the first driven conveyance roller 55*b* that contacts the first drive roller and rotates following the first drive roller. The second conveyance roller pair is disposed downstream from the plurality of image reading units to convey the recording medium such as the sheet P. The second conveyance roller pair includes a second drive roller such as the second drive conveyance roller 56*a* and a second driven roller such as the second driven conveyance roller 56*b* that contacts the second drive roller and rotates following the second drive roller. The reading interval between the image reading positions of the upstream image reading unit and the downstream image reading unit is an integral multiple of a circumference of at least one of the first drive roller and the second drive roller.

With this configuration, similarly to Aspects 1 and 2, the image deviation is prevented between the upstream scanned image and the downstream scanned image of the composite scanned image.

Aspect 11

In any one of Aspects 1 to 10, the plurality of image reading units is one of an equal magnification optical system such as the CIS as illustrated in FIG. 10 and a reduced optical system such as the CCD as illustrated in FIG. 2.

Aspect 12

An image forming apparatus includes an image forming device to form an image on a recording medium and the image reading device according to any one of Aspects 1 to 11.

With this configuration, the image deviation is prevented between the upstream scanned image and the downstream scanned image of the composite scanned image.

As described above, according to the present disclosure, an abnormal image can be prevented from being generated in a composite scanned image in which scanned images read by a plurality of image reading units are combined.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. An image reading device comprising:

a plurality of image reading units configured to read an image on a recording medium at respective image reading positions, the plurality of image reading units arranged at different positions in a width direction perpendicular to a conveyance direction of the recording medium, the plurality of image reading units including:

an upstream image reading unit; and a downstream image reading unit downstream from the upstream image reading unit in the conveyance direction; and a conveyance roller pair configured to convey the recording medium to the plurality of image reading units, the conveyance roller pair including:

a drive roller; and a driven roller configured to contact the drive roller and rotate following the drive roller, wherein a reading interval between the respective image reading positions and a first diameter of the drive roller satisfy the following relation:

$X2=n1\times\pi\times D1a$, where X2 represents the reading interval, n1 represents an integer, and D1a represents the diameter of the drive roller, and wherein the reading interval and a second diameter of the driven roller satisfy the following relation:

$X2=n3\times\pi\times D1b$, where X2 represents the reading interval, n3 represents an integer, and D1b represents the second diameter of the driven roller.

2. The image reading device according to claim 1, further comprising another conveyance roller pair configured to convey the recording medium passing through the plurality of image reading units, said another conveyance roller pair including:

another drive roller; and another driven roller configured to contact said another drive roller and rotate following said another drive roller, wherein the reading interval and a diameter of said another drive roller satisfy the following relation:

$X2=n2\times\pi\times D2a$, where n2 represents an integer and D2a represents the third diameter of said another drive roller.

3. The image reading device according to claim 2, wherein said another drive roller has the third diameter same as the first diameter of the drive roller, and wherein a fluctuation of a conveyance speed with a rotation cycle of the drive roller is in phase with a fluctuation of a conveyance speed with a rotation cycle of said another drive roller.

4. The image reading device according to claim 3, wherein a distance from the conveyance roller pair to said another conveyance roller pair is an integral multiple of a circumference of the drive roller.

5. The image reading device according to claim 2, wherein the reading interval and a diameter of said another driven roller satisfy the following relation:

$X2=n4\times\pi\times D2b$, where n4 represents an integer and D2b represents the fourth diameter of said another driven roller.

6. The image reading device according to claim 1, wherein the driven roller is configured to measure a length of the recording medium in the conveyance direction.

7. The image reading device according to claim 1, wherein a distance from the conveyance roller pair to each of the respective image reading positions of the plurality of image reading units is an integral multiple of a circumference of the drive roller.

8. An image forming apparatus comprising:

an image forming device configured to form an image on a recording medium; and the image reading device according to claim 1.

9. The image reading device of claim 1, further comprising another conveyance roller pair configured to convey the recording medium passing through the plurality of image reading units, said another conveyance roller pair including:

another drive roller; and another driven roller configured to contact said another drive roller and rotate following said another drive roller, wherein a first distance from the conveyance roller pair to a first one of the image reading positions is an integral multiple of a circumference of the drive roller;

wherein a second distance from a second one of the image reading positions to the another conveyance roller pair is an integral multiple of the circumference of the drive roller.

10. The image reading device of claim 9, wherein a total distance between the conveyance roller pair and the another conveyance roller pair is a sum of the first distance, the reading interval, and the second distance.

11. An image reading device comprising:

a plurality of image reading units configured to read an image on a recording medium at respective image reading positions, the plurality of image reading units arranged at different positions in a width direction perpendicular to a conveyance direction of the recording medium, the plurality of image reading units including:

an upstream image reading unit; and a downstream image reading unit downstream from the upstream image reading unit in the conveyance direction; and a conveyance roller pair configured to convey the recording medium passing through the plurality of image reading units, the conveyance roller pair including:

a drive roller; and a driven roller configured to contact the drive roller and rotate following the drive roller, wherein a reading interval between the respective image reading positions and a first diameter of the drive roller satisfy the following relation:

$X2=n2\times\pi\times D2a$, where X2 represents the reading interval, n2 represents an integer, and D2a represents the diameter of the drive roller, wherein the reading interval and a second diameter of the driven roller satisfy the following relation:

$X2=n4\times\pi\times D2b$, where X2 represents the reading interval, n4 represents an integer, and D2b represents the second diameter of the driven roller.

12. The image reading device of claim 11, wherein the driven roller is configured to measure a length of the recording medium in the conveyance direction.

13. The image reading device of claim 11, further comprising another conveyance roller pair configured to convey the recording medium to the plurality of image reading units, said another conveyance roller pair including:

another drive roller; and another driven roller configured to contact said another drive roller and rotate following said another drive roller, wherein a first distance from the another conveyance roller pair to a first one of the image reading positions is an integral multiple of a circumference of the another drive roller;

wherein a second distance from a second one of the image reading positions to the conveyance roller pair is an integral multiple of the circumference of the another drive roller.

14. The image reading device of claim 13, wherein a total distance between the another conveyance roller pair and the conveyance roller pair is a sum of the first distance, the reading interval, and the second distance.

15. An image reading device comprising:

a plurality of image reading units configured to read an image on a recording medium at respective image reading positions, the plurality of image reading units arranged at different positions in a width direction perpendicular to a conveyance direction of the recording medium and, the plurality of image reading units including:

an upstream image reading unit; and a downstream image reading unit downstream from the upstream image reading unit in the conveyance direction; and a first conveyance roller pair upstream from the plurality of image reading units, configured to convey the recording medium, the first conveyance roller pair including:

a first drive roller; and a first driven roller configured to contact the first drive roller and rotate following the first drive roller; and a second conveyance roller pair downstream from the plurality of image reading units, configured to convey the recording medium, the second conveyance roller pair including:

a second drive roller; and a second driven roller configured to contact the second drive roller and rotate following the second drive roller, wherein a reading interval between the respective image reading positions of the upstream image reading unit and the downstream image reading unit being a first integral multiple of a first circumference of the first drive roller and the second drive roller, wherein the reading interval between the respective image reading positions of the upstream image reading unit and the downstream image reading unit is a second integral multiple of a second circumference of the first driven roller and the second driven roller.

16. The image reading device according to claim 15, wherein each of the plurality of image reading units includes one of an equal magnification optical system and a reduced optical system.

17. The image reading device according to claim 15, wherein the first circumference and the second circumference are different.

18. The image reading device according to claim 15, wherein the first driven roller is configured to measure a length of the recording medium in the conveyance direction.

19. The image reading device of claim 15, wherein a first distance from the first conveyance roller pair to a first one of the image reading positions is an integral multiple of the first circumference of the first drive roller; and wherein a second distance from a second one of the image reading positions to the second conveyance roller pair is an integral multiple of the first circumference of the first drive roller.

20. The image reading device of claim 19, wherein a total distance between the first conveyance roller pair and the second conveyance roller pair is a sum of the first distance, the reading interval, and the second distance.

* * * * *